US007644658B2

(12) United States Patent
Nagler et al.

(10) Patent No.: US 7,644,658 B2
(45) Date of Patent: Jan. 12, 2010

(54) TRANSFER DRUM AND BLANKET FASTENING ASSEMBLY

(75) Inventors: Sharon Nagler, Gan Yavna (IL); Vadim Genkin, Gealia (IL); Lior Lewinz, Rechovot (IL); Haim Yushtein, Nethanya (IL); Yossi Rosen, Sitriya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 495 days.

(21) Appl. No.: 11/249,199

(22) Filed: Oct. 13, 2005

(65) Prior Publication Data

US 2007/0084371 A1 Apr. 19, 2007

(51) Int. Cl.
*B41F 30/04* (2006.01)
*B41F 27/12* (2006.01)

(52) U.S. Cl. ..... 101/415.1; 399/302; 101/217

(58) Field of Classification Search ..... 101/415.1, 101/409, 489

See application file for complete search history.

(56) References Cited

U.S. PATENT DOCUMENTS

| | | | | | |
|---|---|---|---|---|---|
| 3,156,184 | A * | 11/1964 | Shank | ..... | 101/415.1 |
| 3,896,729 | A * | 7/1975 | Moyer | ..... | 101/415.1 |
| 4,006,686 | A * | 2/1977 | Ackerman | ..... | 101/415.1 |
| 4,010,685 | A * | 3/1977 | Trageser | ..... | 101/415.1 |
| 4,599,943 | A * | 7/1986 | Kobler | ..... | 101/217 |
| 5,088,410 | A * | 2/1992 | Murakami | ..... | 101/415.1 |
| 5,745,829 | A * | 4/1998 | Gazit et al. | ..... | 399/302 |
| 2005/0249530 | A1 * | 11/2005 | McLean et al. | ..... | 399/302 |

* cited by examiner

*Primary Examiner*—Leslie J Evanisko

(57) ABSTRACT

A blanket fastening assembly for securing an image transfer blanket to an intermediate transfer member drum of an electrostatic printer comprising a resilient biasing arrangement adapted to be connected to an end of the blanket to act in use so as to resiliently tension the blanket, with at least one end portion of the blanket being held in use by a resilient biasing clamping member which is adapted to move during the operational life of the drum so as to accommodate stretching of the blanket whilst maintaining tension in the blanket.

20 Claims, 18 Drawing Sheets

TRANSFER DRUM AND BLANKET FASTENING ASSEMBLY

FIELD OF THE INVENTION

The present invention relates generally to printers and printing and, more particularly, although not exclusively, to liquid electrostatic printing (LEP), and to digital printing primarily, but not exclusively, on a large industrial scale as opposed to (relatively) low volume office printers.

BACKGROUND TO THE INVENTION

Imaging systems of electrostatic or electrophotographic printers comprise an image transfer arrangement which receives a toner or pigment image thereon and then transfers the image onto a substrate, such as paper. The image transfer arrangement may comprise an image transfer blanket which is mounted around a (rotatable) blanket mounting body so as to form an intermediate transfer member or drum. It is known for the blankets to be attached to the mounting body by glue. However, removal of a worn blanket and installation of a new one involves first removing the used blanket and then gluing the new blanket on. Removal and installation of blankets is a time-consuming and highly skilled procedure. The time-related reduction in printing capacity caused by changing blankets is significant since electrostatic printers used on an industrial scale may require of the order of around two hundred replacement blankets per year.

We seek to provide an improved method of attaching an image transfer blanket to a blanket mounting body, and an improved image transfer member or assembly.

STATEMENTS OF INVENTION

According to one aspect of the invention there is provided a blanket fastening assembly for securing an image transfer blanket to an intermediate transfer member drum of an electrostatic printer, the fastening assembly comprises a resilient biasing arrangement adapted to be connected to an end of the blanket to act in use so as to resiliently tension the blanket, with at least one end portion of the blanket being held in use by a resiliently biased clamping member which is adapted to move during the operational life of the drum so as to accommodate stretching of the blanket whilst maintaining tension in the blanket.

According to another aspect of the invention there is provided an intermediate transfer member of a printer comprising a drum member and an image transfer blanket which extends around the drum member and is attached to the drum member, the blanket being adapted to receive a pigmented image and to transfer the image therefrom, and wherein the drum member is provided with a blanket fixing assembly adapted to removably secure the blanket to the drum member, the blanket fixing assembly comprising a resilient blanket tensioner securing an end of the blanket and resiliently tensioning the blanket circumferentially of the drum member.

According to another aspect of the invention there is provided a printer comprising imaging apparatus adapted to generate an ink image to be transferred to a substrate, the imaging apparatus comprising a blanket-mounting drum around which an image transfer blanket is removably secured, the blanket being adapted to receive an ink image for subsequent transfer therefrom, wherein the blanket is secured to the blanket mounting drum by a blanket fastening assembly comprising a spring-biased connector which is adapted to be connected to an end of the blanket so as to tension the blanket circumferentially of the blanket mounting drum.

According to a further aspect of the invention there is provided an intermediate transfer member drum for a printer having a blanket fixing assembly for removably securing an image transfer blanket around the drum, the blanket fixing assembly comprising a resiliently biased connector for attaching an end of the blanket so as to resiliently tension the blanket around the drum.

According to another aspect of the invention there is provided a method of removably attaching an image transfer blanket to an intermediate transfer member drum of a printer imaging system, the method comprising urging an end of the blanket circumferentially of the drum so as to tension the blanket and retain the blanket to the drum.

According to yet a further aspect of the invention there is provided a process of printing comprising receiving an ink image on an image transfer blanket of an image transfer member, holding the image transfer blanket on the image transfer member by circumferential tension in the blanket, compensating for elongation of the blanket by using a blanket tensioning mechanism which creates a circumferential tension independently of the precise position of the ends of the blanket, and transferring the ink image from the blanket to another surface.

According to another aspect of the invention there is provided an image transfer blanket for a printer comprising an image transfer surface adapted to receive and release an ink image, an electrically biasing layer adapted to cause the blanket in use to have an electrical potential, a first end region and a second, spaced, end region, the blanket being adapted to be wrapped around a drum in use with the first and second end regions generally adjacent each other, wherein at least one of the end regions has at least one of:

(i) apertures adapted to locate around projections of the drum and to control the positioning of the blanket on the drum;

(ii) a blanket clamping strip attached to said end portion and adapted to be releasably engaged by blanket clamping strip fixing formations on the drum;

(iii) a blanket clamping strip attached to said end portion and adapted to be releasably engaged by blanket clamping strip fixing formations on the drum, and said strip having teeth which extend through the blanket to the electrically biasing layer and which are electrically conductively coupled to the electrically biasing layer.

According to another aspect of the invention there is provided a blanket fastening assembly for securing means for receiving and transferring an ink image to means for mounting the blanket of printer imaging means, the fastening assembly comprises means for providing a resilient bias which is adapted to be connected to an end of the blanket to act in use so as to resiliently tension the blanket.

Further aspects of the invention relate to image transfer blankets which are adapted to be connected to a blanket attachment assembly of the first aspect of the invention. One aspect of the invention relates to an image blanket at least one end of which comprises a locating formation which is adapted to be received by a complimentary formation of a blanket attachment assembly. In one embodiment the locating formation is adapted to be manually push-fitted into engagement with a complimentary formation of the blanket attachment assembly, and manually detachable from the blanket attachment assembly.

According to another aspect of the invention there is provided a method of increasing the available printing area of a printer having an intermediate transfer member and an image transfer blanket thereon, the method comprising using tension biasing blanket attachment assemblies and reducing the tension to which the blanket is subjected, and removing clamp members to enable the blanket to be re-positioned if the blanket is misaligned on the intermediate transfer member.

According to one aspect of the invention there is provided an image transfer blanket comprising at least one of (i) one or more apertures in end adapted to fit around one or more projections, (ii) a mounting strip which is fastened to an end of the blanket and adapted to inter-engage with a strip engaging arrangement associated with a blanket mounting body and (iii) a blanket clamping portion provided around one end of the blanket, which is shaped to be curved back on itself and be receivable in an opening of a blanket attachment assembly.

According to a further aspect of the invention there is provided a method of compensating for initial stretching of blanket and/or creep in use comprising circumferentially tensioning an image transfer blanket with a lost motion device coupled to an end of the blanket.

According to one aspect of the invention there is provided a method of mounting a blanket on an intermediate transfer member comprising gripping one end of the blanket with a gripper assembly and tensioning the blanket circumferentially by moving the gripper assembly.

According to a yet further aspect of the invention there is provided a blanket mounting unit for fitting into axial channel of an intermediate transfer member drum comprising a base, first and second blanket fixing formations, at least one of the blanket fixing formations being moveable relative to the base, a biasing mechanism adapted to bias at least said one of the blanket fixing formations so as to urge it in a direction so as to tension a blanket in use.

The at least one blanket fixing formation may be guided for linear movement.

According to a further aspect of the invention there is provided a method of printing in a printer which printer comprises an intermediate transfer member which is adapted to transfer a layer of ink/fused particles from a photo-charged developer member to a substrate to be printed on, the method comprising using an image transfer blanket wrapped around the intermediate transfer member to convey ink/toner to the substrate or a further intermediate transfer member and maintaining a smooth surface of the blanket by wrapping it around a drum in a substantially glue-less manner and applying tangentially applied forces to the ends of blanket to keep the blanket taut.

According to one aspect of the invention there is provided a method of removing an image transfer blanket from an intermediate transfer member assembly of an electrostatic printer, comprising reducing the tension applied to the blanket by a resilient biasing arrangement, and detaching each end of the blanket from the intermediate transfer member assembly.

According to another aspect of the invention there is provided a blanket fastening assembly comprising a de-tensioning arrangement which, in use, acts on the resilient biasing arrangement to reduce the tension to which the blanket is subjected.

According to another aspect of the invention there is provided a tension reducing mechanism for a blanket attachment assembly of an intermediate transfer member of a printer, the tension reducing mechanism being adapted to be capable of acting on a resilient biasing arrangement of the blanket attachment assembly so as to reduce the tension to which an attached image transfer blanket is subjected.

Such a tension reducing mechanism may be hand powered or machine powered.

BRIEF DESCRIPTION OF THE DRAWINGS

Various embodiments of the invention will now be described by way of example only, with reference to the accompanying drawings, in which.

DETAILED DESCRIPTION OF EMBODIMENTS

Although one particular printer will be described it will be appreciated that the invention is applicable to many different kinds of printer, and there is no intention to limit protection to printers of the same kind as that shown in FIGS. 1 and 2.

Figure 1:
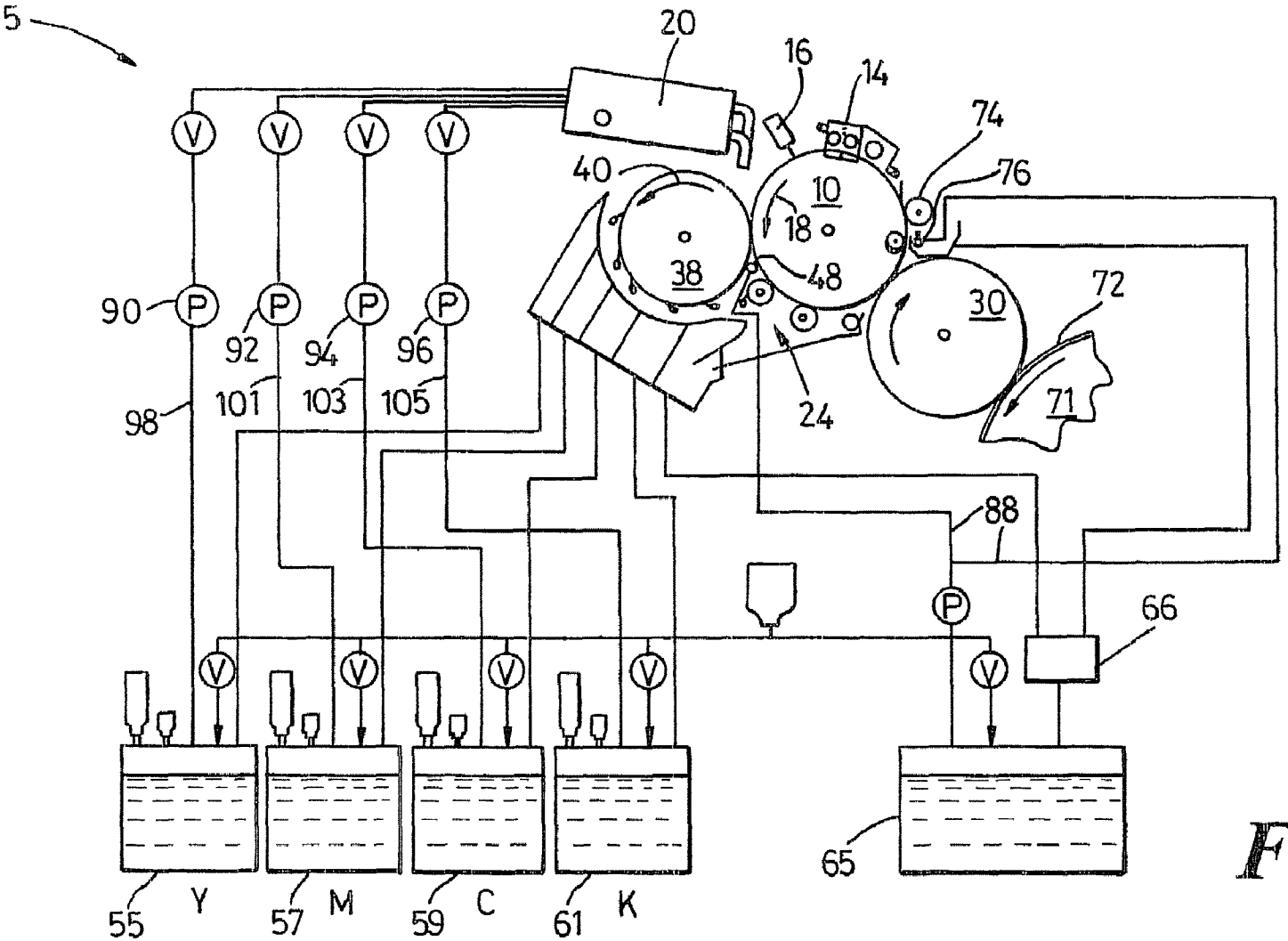
FIG. 1 is a schematic representation of imaging apparatus of a liquid electrostatic printer in accordance with an embodiment of the invention.
Figure 2:
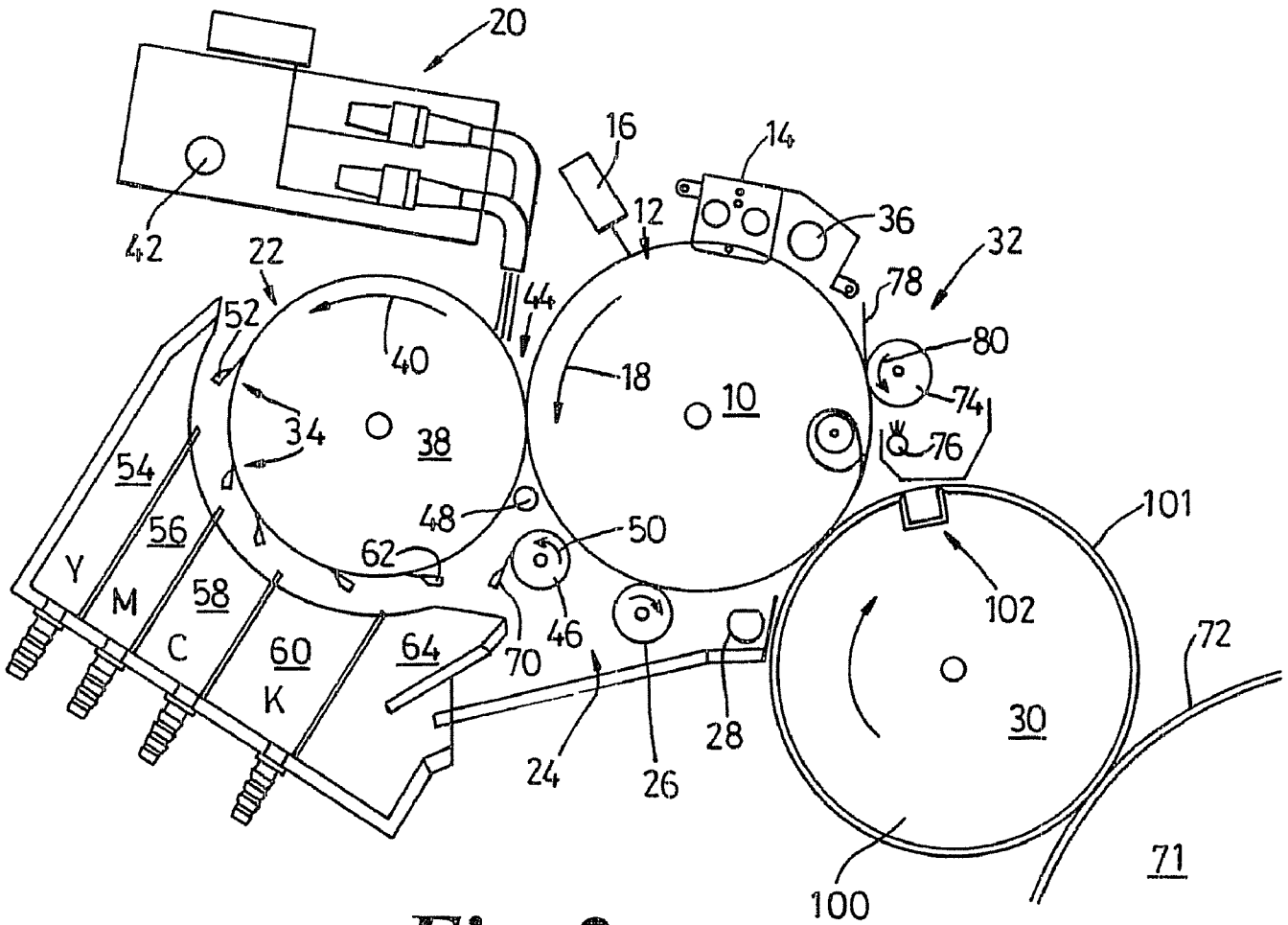
FIG. 2 is a more detailed view of part of the imaging apparatus of FIG. 1.
Figure 3:
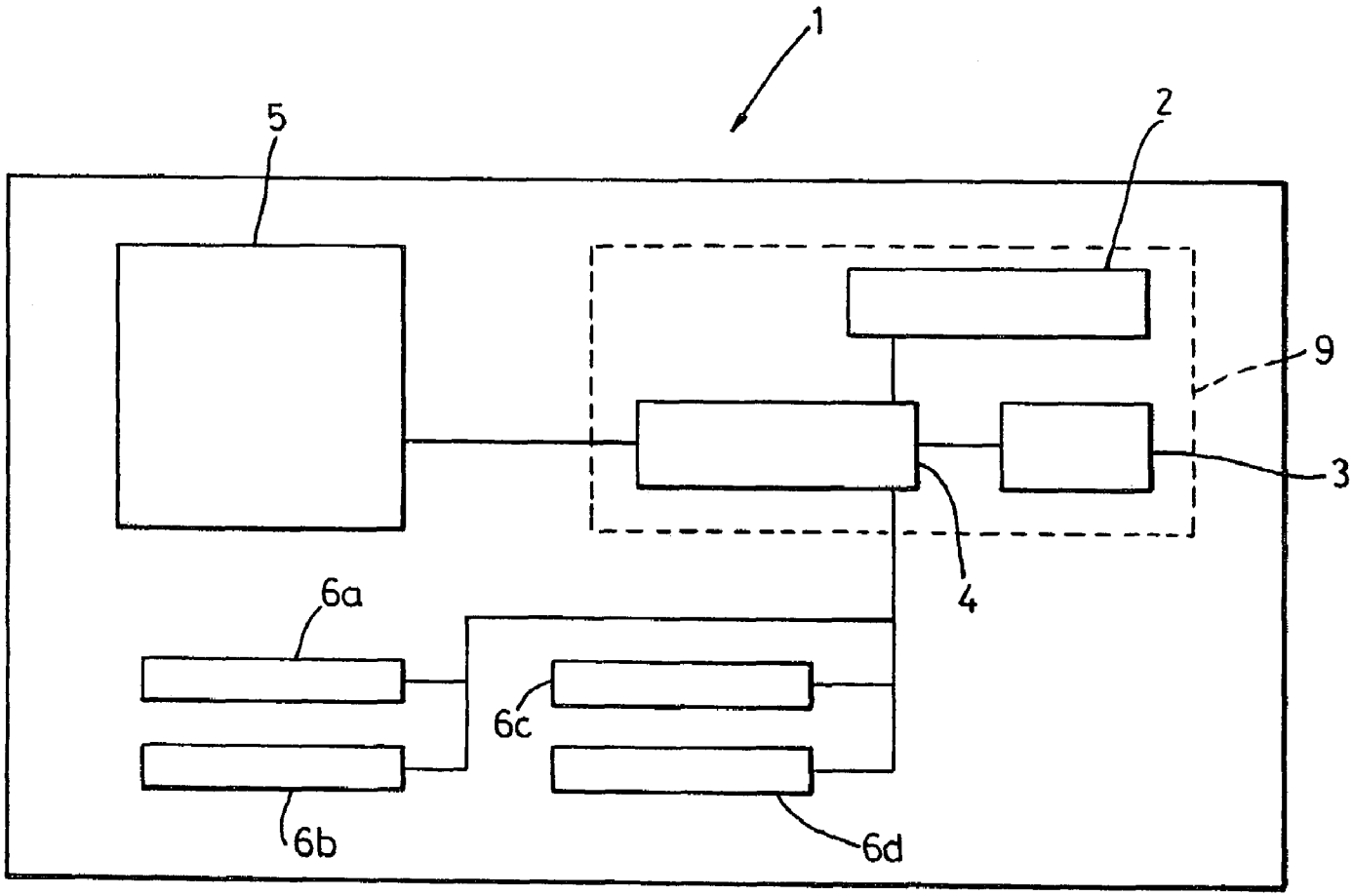
FIG. 3 is a schematic representation of an electrostatic printer including the imaging apparatus of FIGS. 1 and 2.

With reference to FIGS. 1, 2 and 3 there is shown an electrostatic printer 1 which comprises an imaging system 5, a printer control system 9, and substrate feed trays 6*a*, 6*b*, 6*c*, and 6*d*. Although only four such trays are shown, more or less trays may be provided. The printer control system 9 comprises a data processor 4, a memory 3 and a user input/output arrangement 2. The user input/output arrangement provides a Graphic User Interface (GUI) on a display (not shown) and the user is able to manipulate the GUI with input keys/buttons (not shown). It may be however that in an alternative embodiment the printer control system 9 is controlled by an external computer (eg by a PC which is connected to the printer in addition to or instead of the input/output arrangement 2). Alternatively, it may be that the printer control system 9 is remote from the press and is linked/connected thereto by way of a control connection.

In response to instructions from the data processor 4 the operation of the imaging system 5 is controlled to print on any of the substrates stored in one or more of the trays 6*a*, 6*b*, 6*c*, and 6*d*, which substrates are conveyed from their respective trays to the imaging system 5 by a substrate conveying assembly (not illustrated). The imaging system 5 then prints on the substrates so conveyed.

Typical substrates include, but are not limited to, sheet materials such as paper, card, poster-board, textiles, Mylar®, plastic sheet and transparencies, for example.

In use a user of the printer 1 may wish to print, for example, twenty thousand copies of an image on a particular substrate (eg A4 paper of weight 100 gsm). The user may have data representative of the image stored on a data carrier, such as an optical disc. The data carrier is loaded onto a suitable part of the printer 1, or onto a port of a reader device connected/available to the printer, and so the image is made available to the imaging system 5. The user uses the input/output arrangement 2 to identify the substrate type required (for example A4, 100 gsm) and to enter the number of copies required. A calibration process may then be performed on one or more of the chosen substrates to determine the appropriate colour calibration parameters, and those parameters are then stored in the memory 3 for use when the imaging system begins printing onto the substrate to produce the required number of copies.

Reference is now made in particular to FIGS. 1 and 2 which illustrate a (multicolour) electrostatic imaging system 5 constructed and operative in accordance with a preferred embodiment of the present invention. As seen in FIGS. 1 and 2 the imaging system 5 comprises an imaging sheet, preferably an organic photoreceptor 12, typically mounted on a rotating drum 10. Photoreceptor sheet 12 may use any suitable arrangement of layers of materials as is known in the art. Drum 10 is rotated about its axis by a motor or the like (not shown), in the direction of arrow 18, past charging apparatus 14, preferably a corotron, scorotron or roller charger or other suitable charging apparatus known in the art and which is adapted to charge the surface of sheet photoreceptor 12. The image to be reproduced is focused by an imager 16 upon the charged surface 12 at least partially discharging the photoconductor in the areas struck by light, thereby forming the electrostatic latent image. Thus, the latent image normally includes image areas at a first electrical potential and background areas at another electrical potential.

Imager 16 may comprise a modulated laser beam scanning apparatus, an optical focusing device for imaging a copy on a drum, or other imaging apparatus such as is known in the art.

Also associated with drum 10 and photoreceptor sheet 12 is a multicolour liquid developer spray assembly 20, a developing assembly 22, colour specific cleaning blade assemblies 34, a background cleaning station 24, an electrified squeegee 26, a background discharge device 28, an intermediate transfer member drum 30, cleaning apparatus 32, and a neutralizing lamp assembly 36. The construction and functionality of the intermediate transfer member drum 30 (ITM drum) will be described in detail below, but the purpose of the intermediate transfer member 30 is to receive a toner image from the photoreceptor 12 and then transfer that image onto a substrate to be printed upon.

Developing assembly 22 preferably includes a development roller 38. The development roller 38 is preferably spaced from the photoreceptor 12 thereby forming a gap therebetween of typically 40 to 150 micrometers and is charged to an electrical potential intermediate that of the image and background areas of the image. Development roller 38 is thus operative, when maintained at a suitable voltage, to apply an electric field to aid development of the latent electrostatic image.

Development roller 38 typically rotates in the same sense as drum 10 as indicated by arrow 40. This rotation provides for the surface of sheet 12 and development roller 38 to have opposite velocities at the gap between them.

Multicolour liquid developer spray assembly 20, whose operation and structure is described in detail in U.S. Pat. No. 5,117,263, may be mounted on axis 42 to allow assembly 20 to be pivoted in such a manner that a spray of liquid toner containing electrically charged pigmented toner particles can be directed either onto a portion of the development roller 38, a portion of the photoreceptor 12 or directly into a development region 44 between photoreceptor 12 and development roller 38. Alternatively, the developer spray assembly 20 may be fixed to spray in a fixed non-selectable direction. Preferably, the spray is directed onto a portion of the development roller 38.

Colour specific cleaning blade assemblies 34 are operatively associated with the developer roller 38 for separate removal of residual amounts of each coloured toner remaining thereon after development. Each of the cleaning blade assemblies 34 is selectably brought into operative association with developer roller 38 only when toner of a colour corresponding thereto is supplied to development region 44 by spray assembly 20. The construction and operation of cleaning blade assemblies is described in PCT Publication WO 90/14619 and in U.S. Pat. No. 5,289,238.

Each cleaning blade assembly 34 includes a toner directing member 52 which serves to direct the toner removed by the cleaning blade assemblies 34 from the developer roller 38 to separate collection containers 54, 56, 58, and 60, for each colour to prevent contamination of the various developers by mixing of the colours. The toner collected by the collection containers is recycled to a corresponding toner reservoir (55, 57, 59 and 61). A final toner directing member 62 always engages the developer roller 38 and the toner collected thereat is supplied into collection container 64 and thereafter to reservoir 65 via separator 66 which is operative to separate relatively clean carrier liquid from the various coloured toner particles. The separator 66 may be typically of the type described in U.S. Pat. No. 4,985,732.

The background cleaning station 24, typically including a reverse roller 46 and a fluid spray apparatus 48, is provided for use when the imaging speed is very high. The reverse roller 46 which rotates in a direction indicated by arrow 50 is electrically biased to a potential intermediate that of the image and background areas of photoconductive drum 10, but different from that of the development roller. The reverse roller 46 is preferably spaced apart from photoreceptor sheet 12 thereby forming a gap therebetween which is typically 40 to 150 micrometers.

The fluid spray apparatus 48 receives liquid toner from reservoir 65 via conduit 88 and operates to provide a supply of preferably non-pigmented carrier liquid to the gap between sheet 12 and reverse roller 46. The liquid supplied by fluid spray apparatus 48 replaces the liquid removed from drum 10 by the development assembly 22 thus allowing the reverse roller 46 to remove charged pigmented toner particles by electrophoresis from the background areas of the latent image. Excess fluid is removed from the reverse roller 46 by a liquid directing member 70 which continuously engages reverse roller 46 to collect excess liquid containing toner particles of various colours which is in turn supplied to reservoir 65 via a collection container 64 and separator 66.

The apparatus embodied in reference numerals 46, 48, 50 and 70 is not required for low speed systems, but is preferably included in high-speed systems.

The electrically biased squeegee roller 26 is urged against the surface of sheet 12 and is operative to remove liquid carrier from the background regions and to compact the image and remove liquid carrier therefrom in the image regions. Squeegee roller 26 is preferably formed of resilient slightly conductive polymeric material as is well known in the art, and is preferably charged to a potential of several hundred to a few thousand volts with the same polarity as the polarity of the charge on the toner particles. The squeegee roller 26 is made by moulding a soft polyurethane rubber coating onto a metal core, coating the moulded core with a conductive lacquer and coating the lacquer with a low conductivity elastomer. Alternatively, in an alternative embodiment, the moulded coating can be made of an elastomer with a controlled conductivity and the lacquer can be omitted. In a further alternative embodiment, a single coating of controlled conductivity elastomer is used and the outer layer is omitted.

Discharge device 28 is operative to flood the sheet 12 with light which discharges the voltage remaining on sheet 12, mainly to reduce electrical breakdown and improve transfer of the image to intermediate transfer member 30. Operation of such a device in a 'write black' system is described in U.S. Pat. No. 5,280,326.

FIGS. 1 and 2 further show that multicolour toner spray assembly 20 receives separate supplies of liquid coloured toner typically from four different reservoirs 55, 57, 59 and 61. FIG. 1 shows four different coloured toner reservoirs 55, 57, 59 and 61 typically containing the colours Yellow, Magenta, Cyan and, optionally, Black respectively. Pumps 90, 92, 94 and 96 may be provided along respective supply conduits 98, 101, 103 and 105 for providing a desired amount of pressure to feed the coloured toner to multicolour spray assembly 20.

It will be appreciated however that the present invention is equally applicable to monochrome printers and not only to multicolour printers.

Alternatively, the multicolour toner spray assembly 20, which is preferably a three level spray assembly, receives supplies of coloured toner from up to six different reservoirs (not shown) which allows for custom coloured toner in addition to the standard process colours.

It will be appreciated that other toners may alternatively be employed, including powder toners.

Cleaning apparatus 32 is operative to scrub clean the surface of photoreceptor 12 and preferably includes a cleaning roller 74, a sprayer 76 to spray a non-polar cleaning liquid to assist in the scrubbing process and a wiper blade 78 to complete the cleaning of the photoconductive surface. The cleaning roller 74, which may be formed of any synthetic resin known in the art for this purpose, is driven in the same sense as drum 10 as indicated by arrow 80, such that the surface of the roller scrubs the surface of the photoreceptor. Any residual charge left on the surface of photoreceptor sheet 12 may be removed by flooding the photoconductive surface with light from optional neutralizing lamp assembly 36, which may not be required in practice.

In accordance with a preferred embodiment of the invention, after developing each image in a given colour, the single colour image is transferred to intermediate transfer member 30. Subsequent images in different colours are sequentially transferred in alignment with the previous image onto intermediate transfer member 30. When all of the desired images have been transferred thereto, the complete multi-colour image is transferred from the intermediate transfer member 30 to substrate 72. Impression roller 71 only produces operative engagement between the intermediate transfer member 30 and the substrate 72 when transfer of the composite image to substrate 72 takes place. Alternatively, each single colour image is separately transferred to the substrate via the intermediate transfer member. In this case, the substrate is fed through the machine once for each colour or is held on a platen and contacted with the intermediate transfer member 30 for composite image transfer.

Figure 2A:
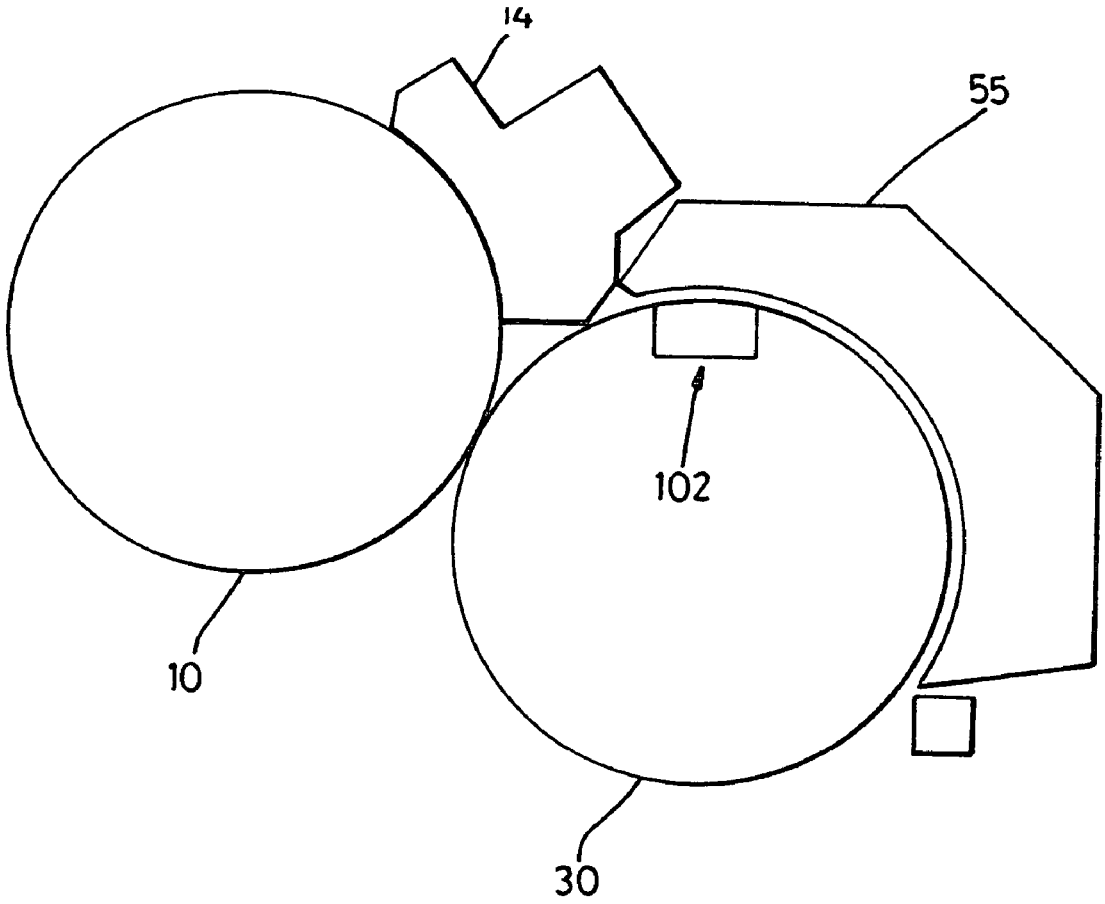
FIG. 2*a* is a schematic representation of part of a modified imaging apparatus.

FIG. 2*a* shows part of a modified imaging apparatus which comprises external heating assembly 55, which in use is operative to heat the outer surface of the intermediate transfer member (ITM) drum 30.

With particular reference now to the ITM drum 30, this comprises a blanket mounting body 100 in the form of a generally cylindrical drum, an image transfer blanket 101 which is of generally layered sheet form and a blanket fastening assembly shown generally at 102 which removably secures the blanket in position around the blanket mounting body 100.

Figures 4, 4A:
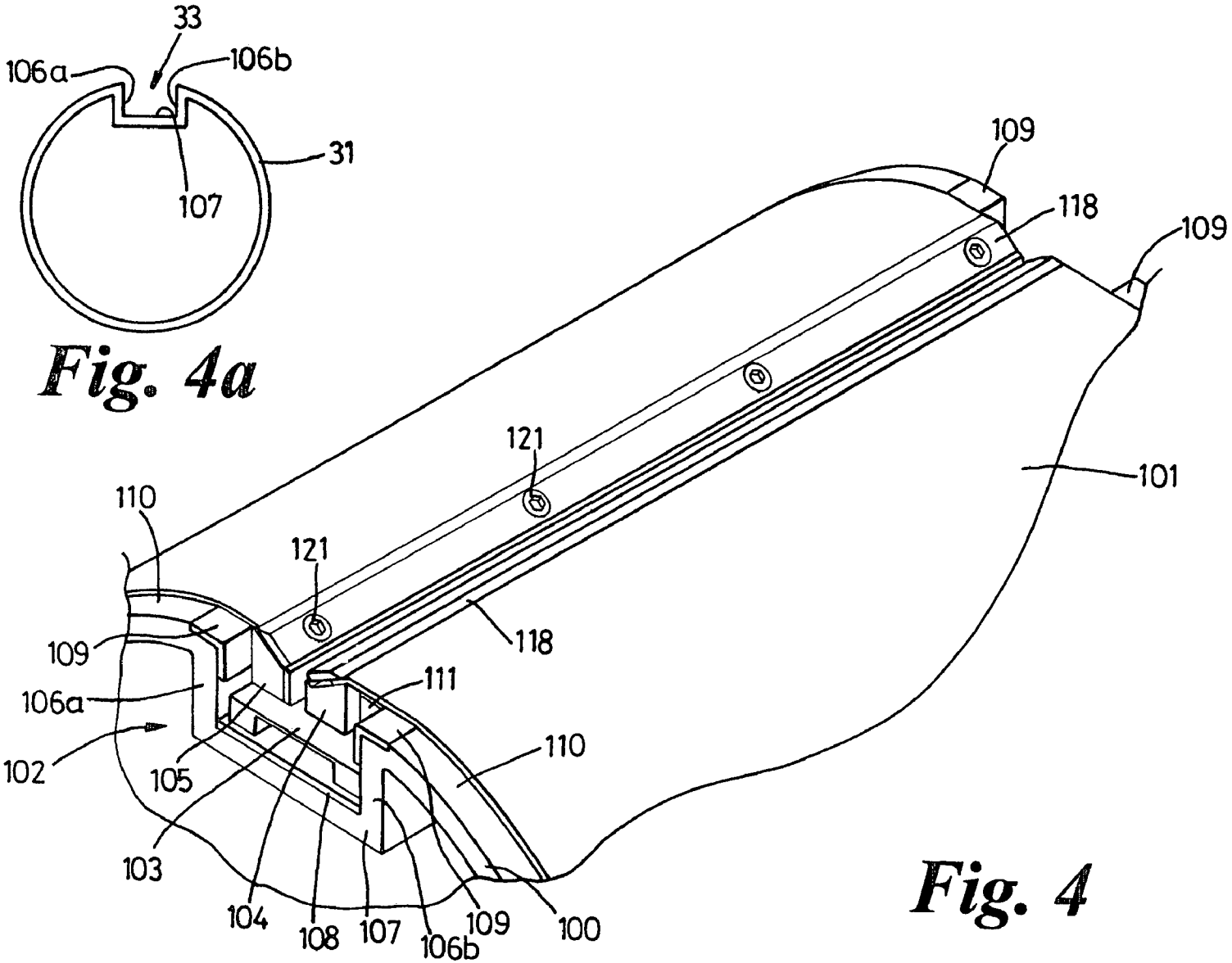
FIG. 4 shows a more detailed view of a blanket securing assembly of the image transfer assembly of the imaging apparatus of FIGS. 1 and 2, FIGS. 4*a* and 4*b* are schematic representations showing how the blanket securing assembly of FIG. 4 is removably attachable to the blanket mounting body.

A more detailed view of the blanket fastening assembly 102 is shown in FIG. 4. The blanket fastening assembly 102 comprises a base 103 on which there is provided a slideably mounted (relative to the base 103) blanket attachment bar 104 and a fixedly mounted (relative to the base 103) blanket attachment bar 105. The blanket fastening assembly 102, or resilient blanket tensioner, is located within a channel 33 or recess of the blanket mounting body 100. In this embodiment the drum 30 has a cylindrical/outer wall 31 which has an axially extending (axially in relation to the central axis of the drum 30) channel formed in it, the channel 33 (see FIG. 4*a*) is defined by axially extending generally radial wall portions 106*a* and 106*b* and a basal portion 107. The fastening assembly 102 is located in the recess 33 by a base plate or portion 108 which supports the base 103 and is made of an electrically insulating material (eg a plastics polymer material). The base plate, or portion, 108 extends for substantially the entire length of the body 100 and is affixed atop the basal portion 107. The fastening assembly 102 is electrically insulated from the body 100.

The fastening assembly 102 is also located in the recess 33 by insulation bars 109 which are provided at the junction of the radial or end wall portions 106*a* and 106*b* and an outer cylindrical surface 110 of the wall 31. The insulating bars 109 are substantially L-shaped in section and formed of electrically insulating material (eg a plastics material/polymer). The insulation bars 109 extend for substantially the full length of the recess 102. One of the insulation bars 109 is fixedly attached to the blanket mounting body 100 at the radial wall portions 106*b* thereof. The other insulation bar 109 is fixed to a back plate 111 which extends along substantially the full length of the recess 33 provided in the blanket mounting body 100. The back plate 111 is fixedly secured to the base 103.

Figure 6:
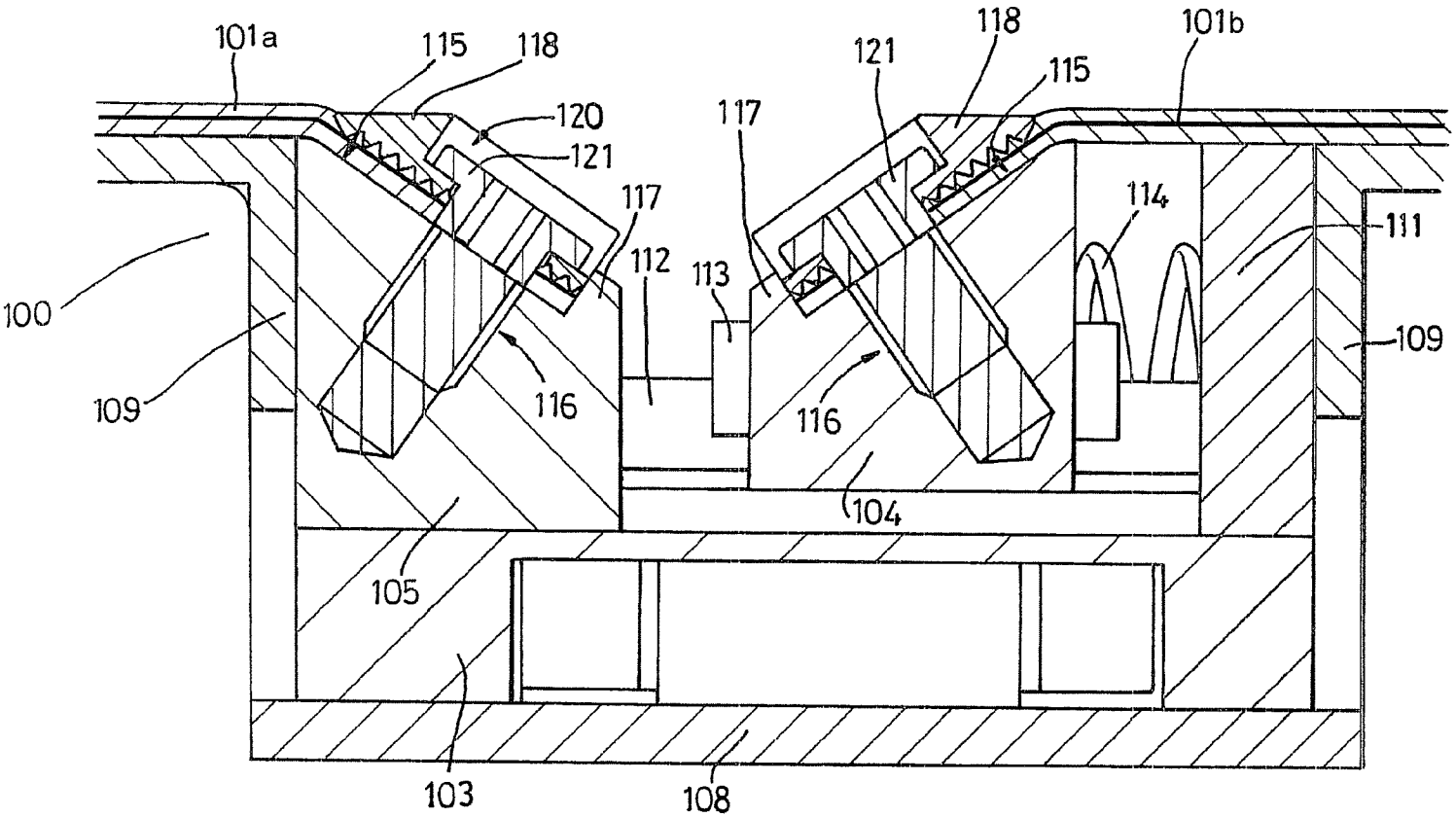
FIG. 6 is a cross-sectional view of the blanket securing assembly shown in FIG. 5 in an assembled condition.

Referring to FIG. 6, multiple rails 112 are provided extending between the back plate 111 and the fixed blanket mounting bar 105. The rails are provided at multiple spaced locations along the length of the recess and are adapted to slidably mount linear bearings 113. The linear bearings 113 sit atop respective rails 112 and are located in suitably sized cut-outs from the bar 104. The rails 112 are of substantially constant cross-section.

Accordingly the bar 104 can be considered as a carriage mounted for linear movement.

Located between the back plate 111 and the slidably mounted blanket attachment bar 104 are multiple springs 114. The springs 114 bear against respective spring abutment surface portions of the back plate 111 and the blanket attachment bar 104 so that the springs 114 act to push the blanket locating bar 104 away from the back plate 111.

Each blanket attachment bar 104 and 105 is provided with an upper surface 115 and a plurality of threaded blind bores 116 which are formed therein. At the lower ends of the surfaces 115 there is provided an upstanding lip 117. As best seen in FIG. 6, each end of the blanket 101 is located on the upper surface 115 of one of the blanket attachment bars 104 and 105 by way of respective clamp plates 118. Each clamp plate 118 is provided with multiple stepped through-holes 120 which are spaced along its length. An underside of each clamp plate 118 is in the form of a field of teeth 119, in this example of substantially saw-tooth configuration. In use the teeth 119 bite into the upper surface portion of each end of the blanket 101 so as to firmly secure the ends of the blanket to the respective blanket securing bars 104 and 105. Threaded fasteners 121 engage with the threaded bores 116 to secure the clamp plates 118 in position so that each clamp plate clamps a respective end of the blanket 101 to the respective blanket securing bar 104 or 105. Each fastener 121 comprises a head portion which comprises a keying formation 123 and a threaded shank 124 (see FIG. 5).

Figure 5:
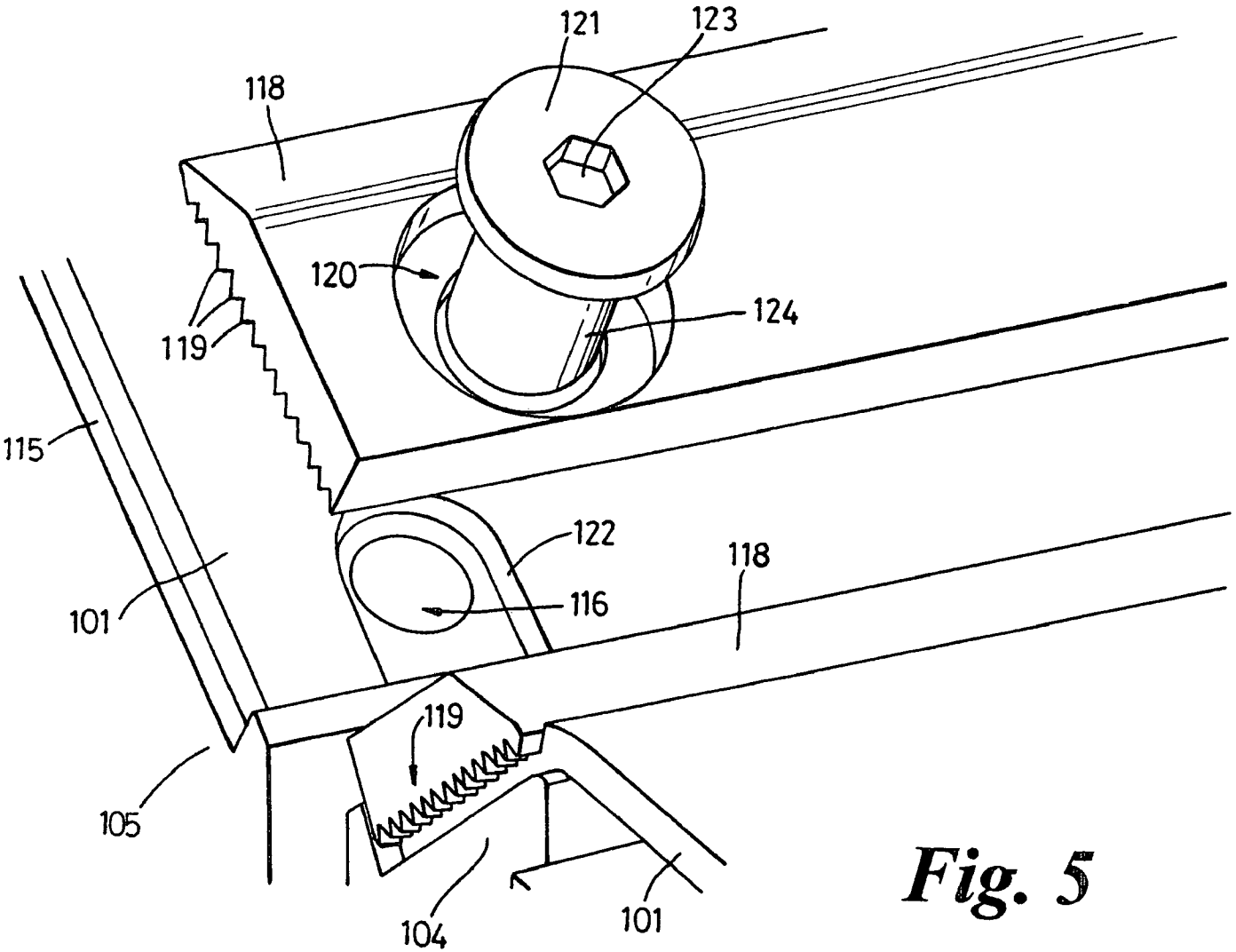
FIG. 5 is an enlarged perspective view of the blanket securing assembly of FIG. 4 in a partially disassembled condition.
Figure 15A:
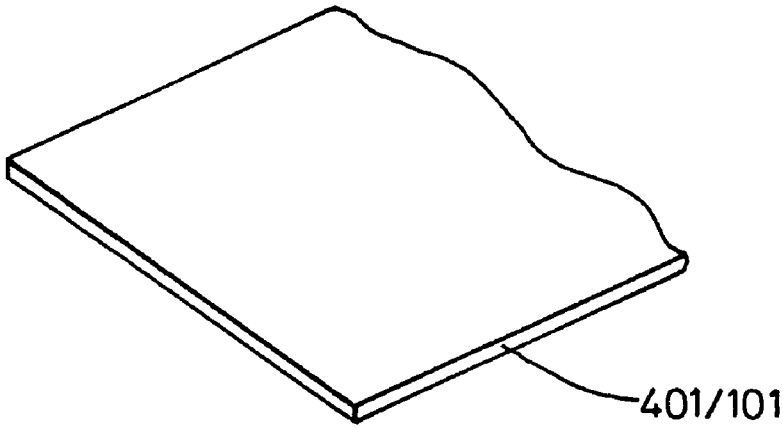
Figure 15B:
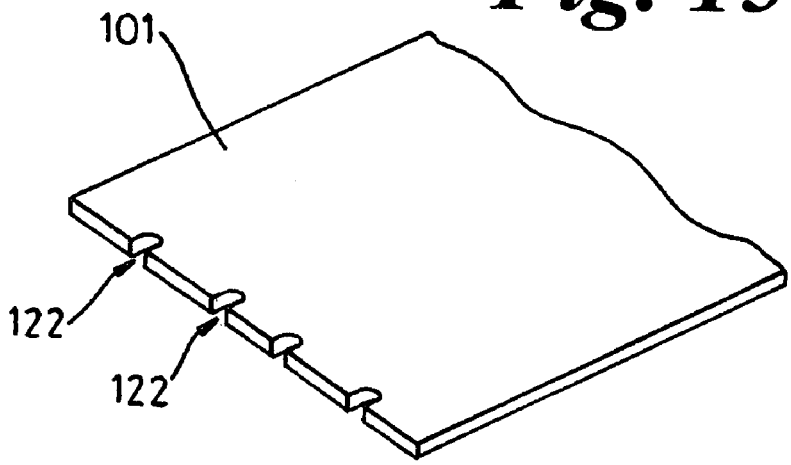

As best seen in FIG. 5, each end of the blanket 101 is provided with multiple U-shaped cut-outs or slots 122 (see also FIG. 15*b*) which are positioned so as to be in register with the opening of a respective threaded blind-bore 116 and around the shank of a respective threaded fastener 121.

Figure 7:
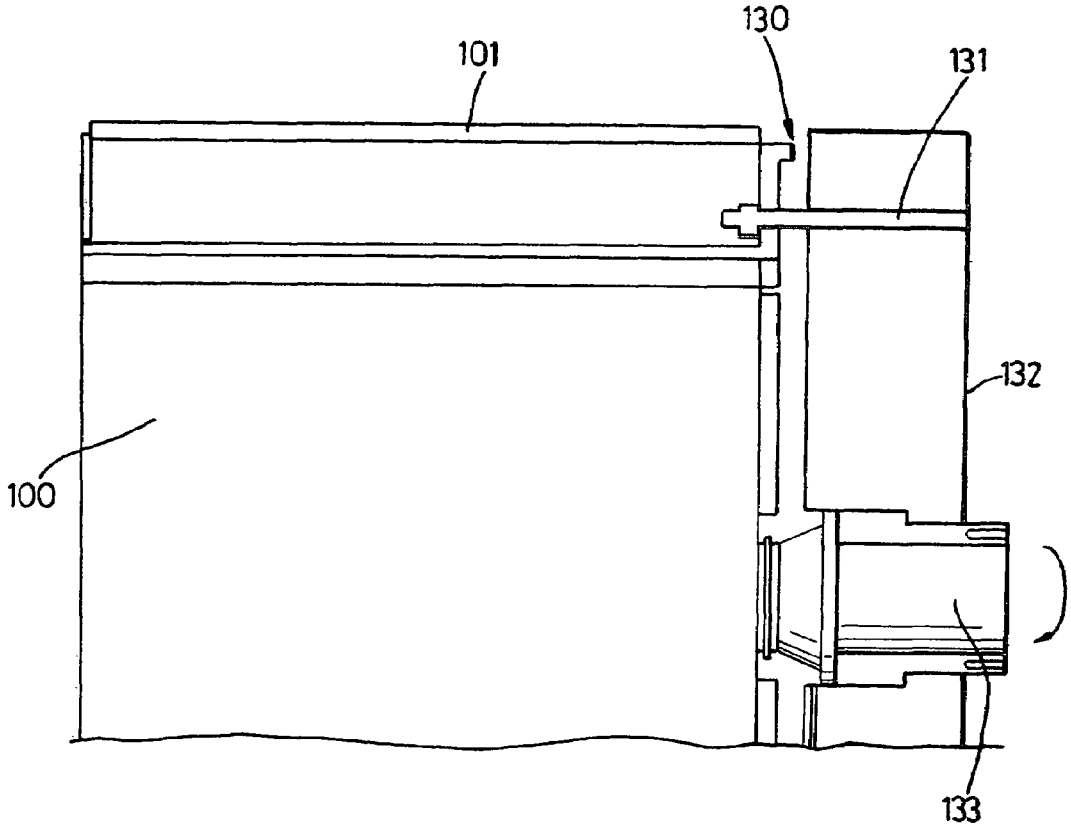
FIG. 7 is a schematic cross sectional view of an image transfer assembly of the embodiment of FIG. 1 which shows an electrical biasing arrangement.

As part of the electrostatic printing process the blanket 101 needs to be maintained at a required electric potential, typically of the order of a few hundred volts, and to that end, and as is well known, the blanket 101 comprises an upper/outer non-electrically conductive layer 101*a* and an inner/lower conductive layer 101*b*, such as a metal grid or array of wires (not illustrated). One or other of the blanket attachment bars 104 and 105 is connected to an electric biasing assembly 130, the arrangement of which is shown schematically in FIG. 7. The electric biasing assembly 130 comprises a connection pin 131 which is detachably connected to a socket arrangement (not illustrated) of the blanket securing assembly 102. The pin 131 extends outwardly from a sub-assembly 132 which co-rotates with the blanket mounting body 100 by way of rotatable driven shaft 133.

The pin 131 is connected to one of the (electrically conductive) blanket fastening or securing bars 104 and 105, which is electrically connected with the threaded fasteners 116 by way of the threaded engagement therebetween. Since the head of each threaded fastener 121 is in contact with the respective clamp plate 118, that clamp plate 118 is also maintained at the voltage of the pin 131. In particular, the teeth 119 of said clamp plate 118 penetrate through the outer/upper non-electrically conductive layer 101*a* of the blanket 101 and contact with the lower/inner conductive layer 101*b*, and accordingly the electrically conductive layer 101*b* of the blanket 101 can be maintained at a required electric potential. The bars 104, 105, and the teeth 119 are typically made of metal (rigid enough to pierce the blanket and electrically conductive).

In order to remove the blanket 101 from the blanket mounting body 100 so as to be able to install a new blanket a user first uses an appropriate tool, such as a Allen key tool (not shown) and inserts the tool into the keying formation 123 of each threaded fastener 121, and loosens each fastener in turn. In another embodiment no tool is needed to release the fasteners 121: a user can do that using their fingers, with no tool being needed. Although not illustrated the threaded fasteners 121 could be retained in each respective blind bores 116 so that the blanket can be released, but the fasteners can be still attached to the bores. Once the fasteners 121 have been sufficiently loosened the user can then pull each clamp plate 118 away from each end of the blanket 101 and the blanket can then be removed from the blanket mounting body 100. The user then installs a replacement blanket by first aligning the slots 122 of one end of the replacement blanket with the shanks 124 of the fasteners 121. The user then urges the blanket into abutment against the lip 117 so that each slot 122 is located around a respective shank. Using the required tool the user then tightens each of the fasteners 121 so as to clamp the clamp plate 118 against the outermost surface of the blanket 101. In so doing the teeth 119 of the clamp plate 118 bite into the outermost surface, and penetrate through the outer/upper non-conductive layer 101*a* and into electrical contact with the inner/lower conductive layer 101*b* of the blanket. The user then takes the other end of the blanket 101 and wraps the blanket around the cylindrical outer surface 110 of the blanket mounting drum 100. The other end of the blanket 101 is then placed on the surface 115 of the other blanket attachment bar and the slots 122 of that end of the blanket are aligned with the shanks 124 of the fasteners. The end of the blanket is then brought into abutment with the lip 117.

The user then clamps the end of the blanket 101 against the surface 115 by way of tightening the fasteners 121 with the required tool. In so doing the teeth 119 of the respective clamp plate 118 will bite into the outermost surface of the blanket, and penetrate through the outer/upper non-conductive layer 101*a* and into the electrical contact with the inner/lower conductive layer 101*b* of said blanket. Accordingly the blanket is now firmly secured around the blanket receiving body 100 and an electrical connection is made with the electrically conductive layer 101*b* of the blanket in order to electrically bias the latter. Advantageously the clamping arrangement of FIG. 4 allows for blankets of different thicknesses to be used. It is desirable that the securing assembly 102 is capable of supporting a blanket with width up to around 330 mm and thickness up to 2.5 mm.

Figure 9:
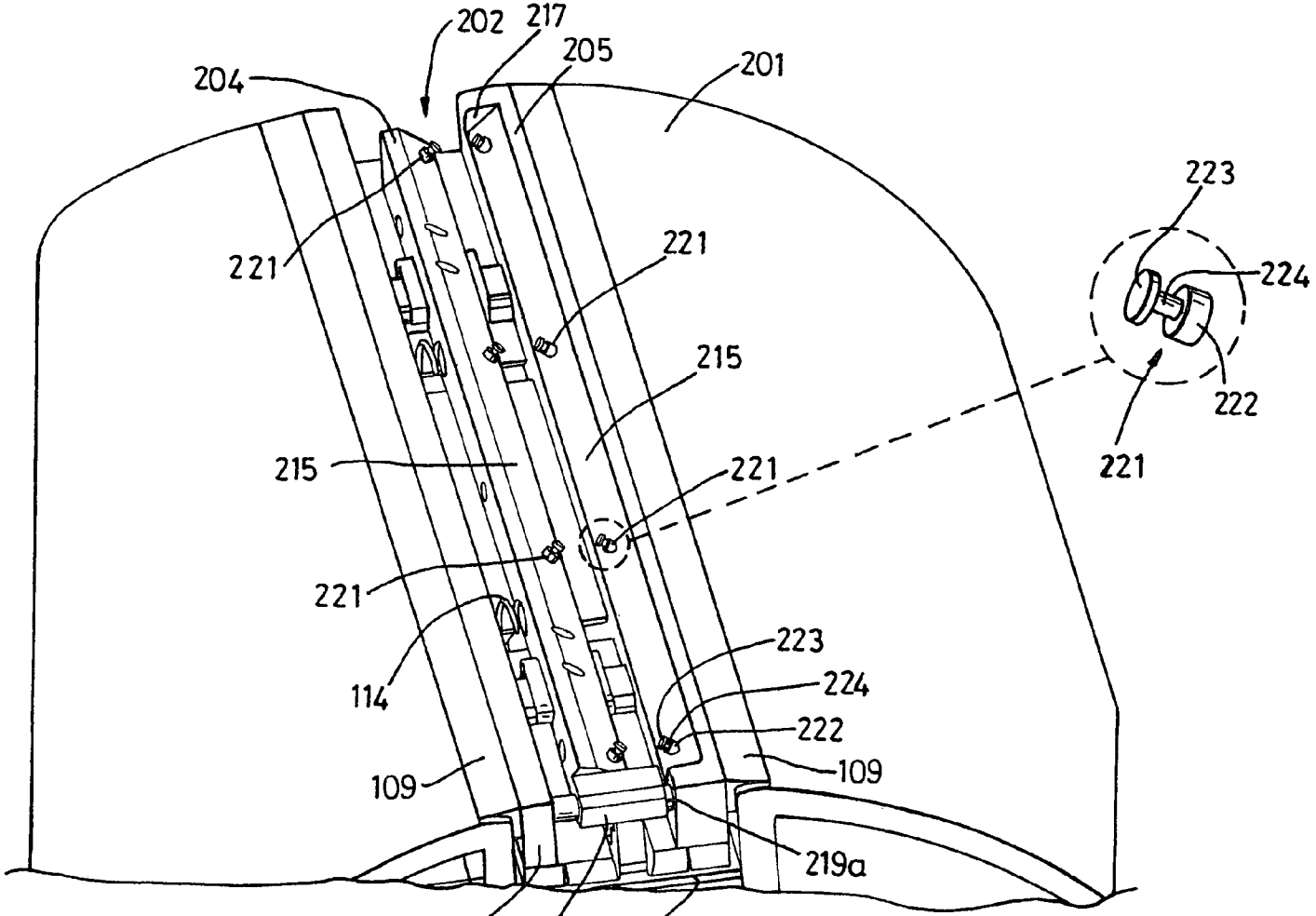
FIG. 9 is a perspective view of the second embodiment of the invention of FIG. 8 in which the image transfer blanket has been removed to more clearly show the blanket securing assembly.

During the step of attaching one end of the blanket to the blanket attachment bar 105 the spring 114 will have been, to some extent, compressed. This may be achieved by a suitable mechanism such as a hydraulic mechanism 219 (as shown in FIG. 9) to bear against the blanket attachment bar 104 to compress the springs in order to attach the blanket.

When the force applied to the bar 104 by the hydraulic mechanism 219 is removed the springs 114 act to tension the blanket in a resilient manner. That is tension is applied to the blanket over a range of circumferential positions of the end of the blanket. The tension may be dependent upon, or be substantially independent of, the extent to which the springs 114 are compressed, depending upon the nature of the compression springs. Advantageously the variation in position of the slidably mounted blanket attachment bar 104 provides a tolerance for variations in the lengths of different blankets, for example the replacement blanket may be a little shorter than the blanket which has been replaced. In known arrangements in which a blanket is glued to a blanket mounting body only very small tolerances in length are permissible in order to install the blanket. For example a blanket may require to be of a length of 1,000 mm with a permitted tolerance of say +/−2 mm. Furthermore, elongation of the blanket due to the initial tensioning of the blanket when installed (it stretches a little during installation), and also elongation overtime due to creep (it stretches more in use over time) is compensated for automatically by virtue the blanket being tensioned by the springs 114. The attachment bar 104 serves as a lost motion mechanism which can accommodate to elongation of up to around 10 mm. Other lost motion mechanisms could be envisaged instead.

The elongation properties of the blanket and the force-with-position characteristics of the springs 114 are chosen to be interrelated: to match each other so that variations in circumferential force experienced by the blanket during its working life (or by slightly different length blankets when initially fitted) are kept to a minimum. In an ideal world, in some embodiments, blankets of slightly different length could be fitted to the ITM drum and they would experience substantially the same, substantially constant, circumferential tension as each other over their working life. This can be achieved by controlling the stretching properties of the blankets and the force with elongation/compression characteristics of the biasing springs.

In addition to compensating for creep of the blanket over time, and elongation of the blanket due to initial tension, a spring biasing mechanism can compensate for variations in drum diameter (e.g. hot, expanded, drum, versus cold, unexpanded, drum). It may not be necessary to cool the drum before changing the blanket, which will save time.

A significant time saving is achieved for removing a used blanket and installing a replacement blanket with the 'glueless' arrangement of the above embodiment as compared to the time taken to perform the same operations for glue-secured blankets. For example whereas the operations of blanket removal and blanket installation of glued-in blankets could take around fifteen to twenty minutes, those operations with the illustrated embodiments require only two to three minutes or so. In view of the fact that industrial scale electrostatic printers could well require a replacement blanket every day or two, the time saved with the illustrated embodiment is significant. It follows that because the printer will be operative for more of the time (because there is less 'down-time' for blanket replacement) the printer is productive for more of the time.

The blanket attachment assembly 102 advantageously provides for a positive and precise mounting of the blanket 101 as a result of the requirement to locate the slots 122 of each end of the blanket around respective shanks of the fasteners 121. This 'positive location' of the axially-extending ends of the blanket facilitates the operation of mounting the blanket 101 on the blanket mounting body 100 and, at the same time, provides for that to be done precisely. Because of the precise location of the ends of the blanket around the body there is less opportunity for the circumferentially-extending edges of the blanket to be in different, axially-displaced positions when blankets are changed. Thus there is a greater degree of certainty of where the side edges of the blanket are on the body and this enables a user to print using a larger image width format instead of having to leave the last few mm of the image clear in case the blanket were to be slightly mis-positioned. For a blanket which is glued to a blanket mounting body because of the rather imprecise nature of the installation procedure the user cannot be sure where the blanket is positioned on the drum and so does not have the degree of certainty required to consider using a larger image width format.

The ease with which the blanket 101 can be installed/removed advantageously does not require high skill by the user. Advantageously long blankets (for large diameter drums) have been difficult to install using glue, because of the need to correctly align the blanket, whereas the arrangement of the various embodiments disclosed herein render such installation significantly easier, and allow a user to try again, with the same blanket, if they try installing it and do misalign it.

The embodiments illustrated in FIGS. 1 to 7 also provide significant cost savings as compared to glue-attached arrangements since no glue is required and the blanket securing assembly 102 can be re-used.

It is also of note that in the situation where there is a problem with the printer and the user is trouble-shooting to determine the cause of the problem it may be that he replaces the blanket with a replacement blanket in order to determine whether the blanket is the cause of the problem. With a glue-attached blanket the process of removing the blanket damages the blanket to the extent that it cannot be re-used. In the case of the above illustrated arrangement however, if after installing a replacement blanket the problem is still occurring the user can simply re-install the first blanket. Accordingly cost saving also results here since blankets are not unnecessarily wasted. Furthermore, blankets are not wasted due to poor location of the blanket on the body, in contrast to a glue-secured arrangements in which unsatisfactory location of the blanket on the blanket mounting body occurs, and so those ill-mounted blankets need to be removed and replaced. With the present arrangement, an ill-positioned blanket can be re-positioned.

In some embodiments it may be possible to remove a blanket that has been fitted to the drum and that is determined to be too long, cut a bit off the length of the blanket, and re-fit it to the same or a different drum. This may require operator skill (in the cutting of the blanket) and may not be so easy, or practicable at all, for blankets with fittings or formations/profiles at their ends. But it might be possible for the arrangement of FIG. 14 or 15*a*, for example, which are described below.

The ends of the blanket are usually referred to as the leading edge and the trailing edge depending on the sense of rotation of the blanket mounting body. The above-described embodiment is advantageously symmetrical, by which it is meant that the blanket can be removed and re-installed such that the end which was the leading edge is now the trailing edge and that end which was the trailing edge is now the leading edge. In this way the direction of applied tension can be easily changed if required.

Although the springs 114 are provided between the back plate 111 and the slideable blanket attachment bar 104, the springs could be provided in other locations for example between the fixedly mounted blanket attachment bar 105 and the slideably mounted blanket attachment bar 104 which, in use, resiliently bias the blanket attachment bar 105 towards the fixedly mounted blanket bar 104. In yet another embodiment both blanket attachment bars are connected to resilient members and are mounted for sliding movement.

The springs need not necessarily comprise helical springs as shown, but could comprise any other spring force member, such as blocks of compressible resilient material, or gas compression springs, or leaf spring, or torsion springs, or something to provide a force that tends to tighten the blanket circumferentially which allows for stretching of the blanket. An electric or hydraulically powered force could be provided to resiliently tension the blanket (resilient to changes in length of the blanket).

Figure 4B:
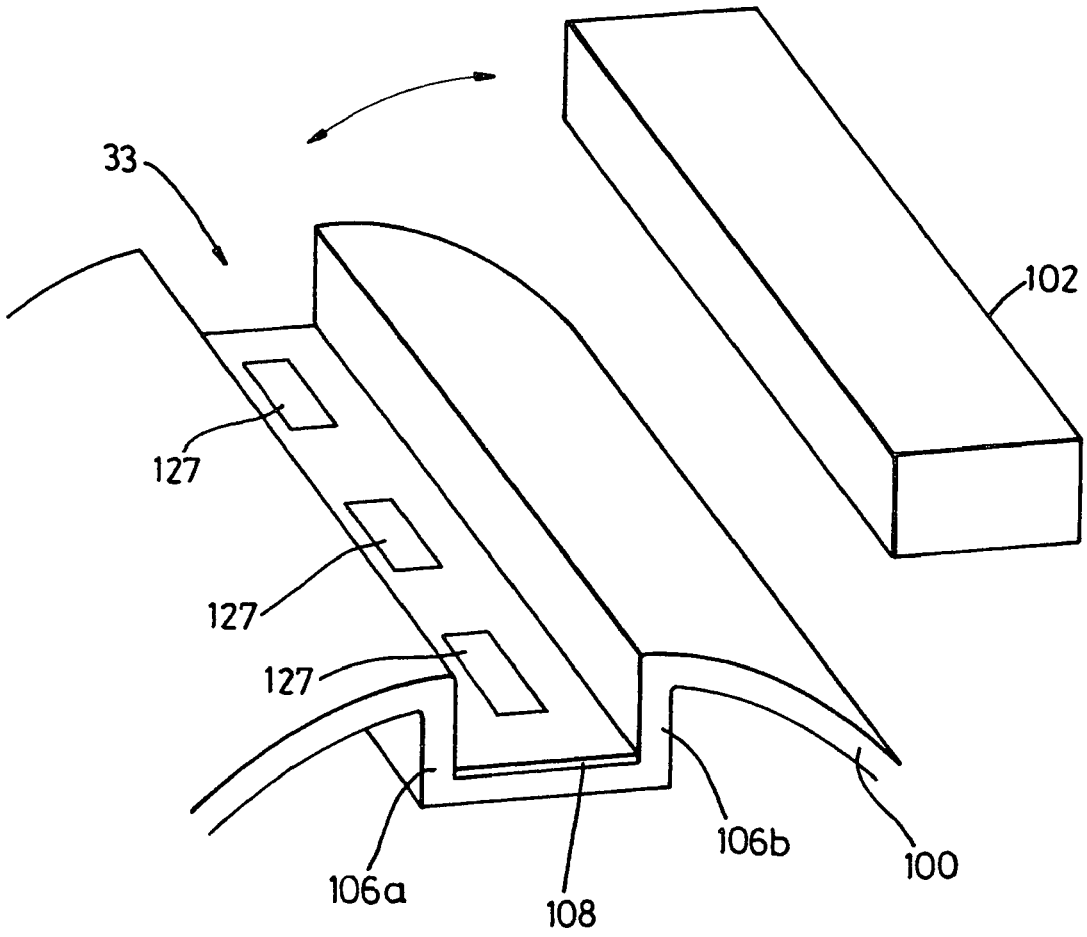

Advantageously the blanket attachment assembly 102 is in the form of a removable unit which is secured (by suitable fasteners) to the electrically insulating base 108 so that a user can easily remove and/or replace the unit for any reason. With reference to FIG. 4*b* the blanket attachment assembly is shown schematically as being removable from the recess 33. The assembly 102 is securable in the recess 33 by way of fastening formations which are received in the complementary openings 127 formed in the plate 108 and the basal portion 107.

Figure 8:
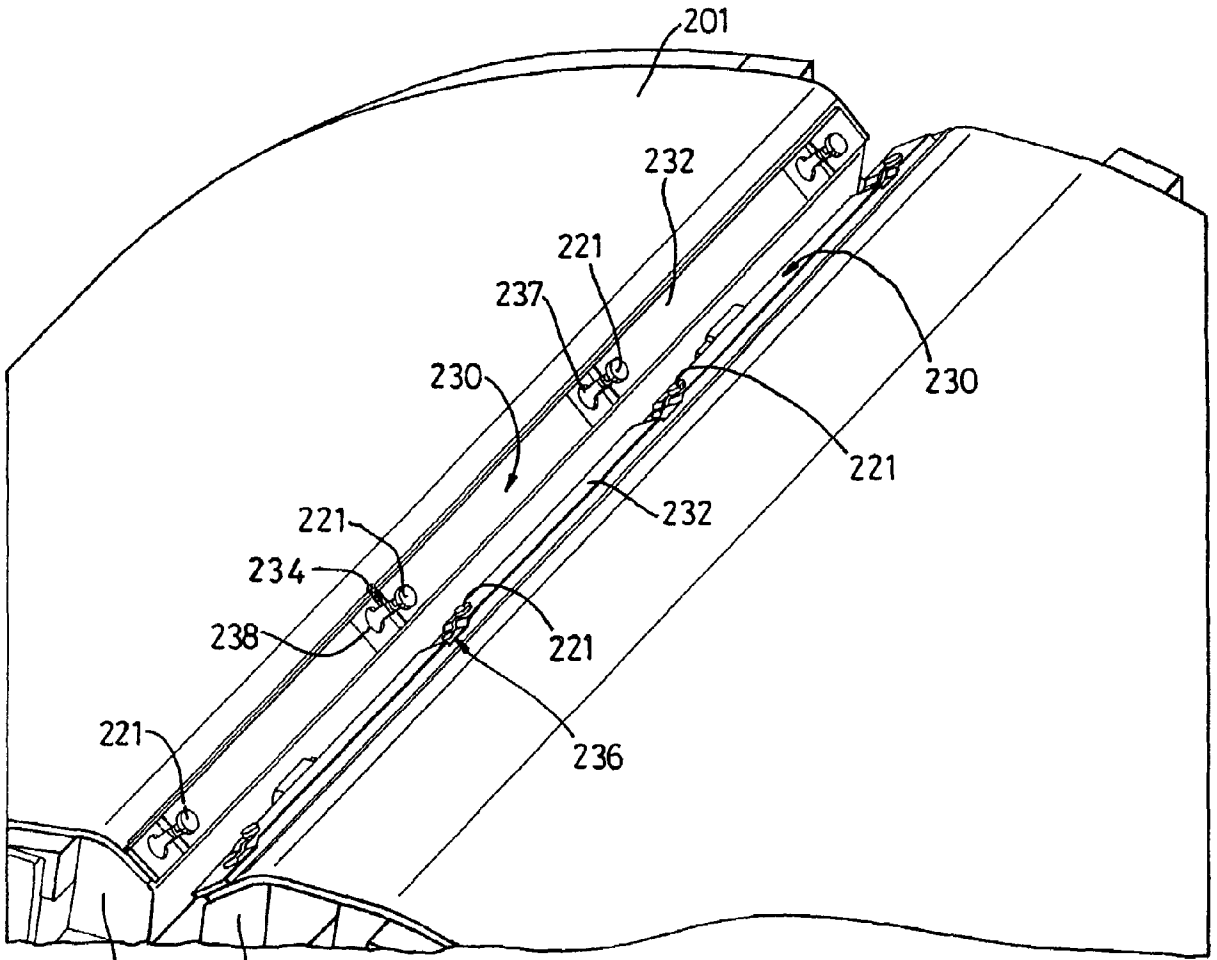
FIG. 8 is a perspective view of a second embodiment of the invention in which an image transfer blanket is attached to a blanket mounting drum.
Figure 10:
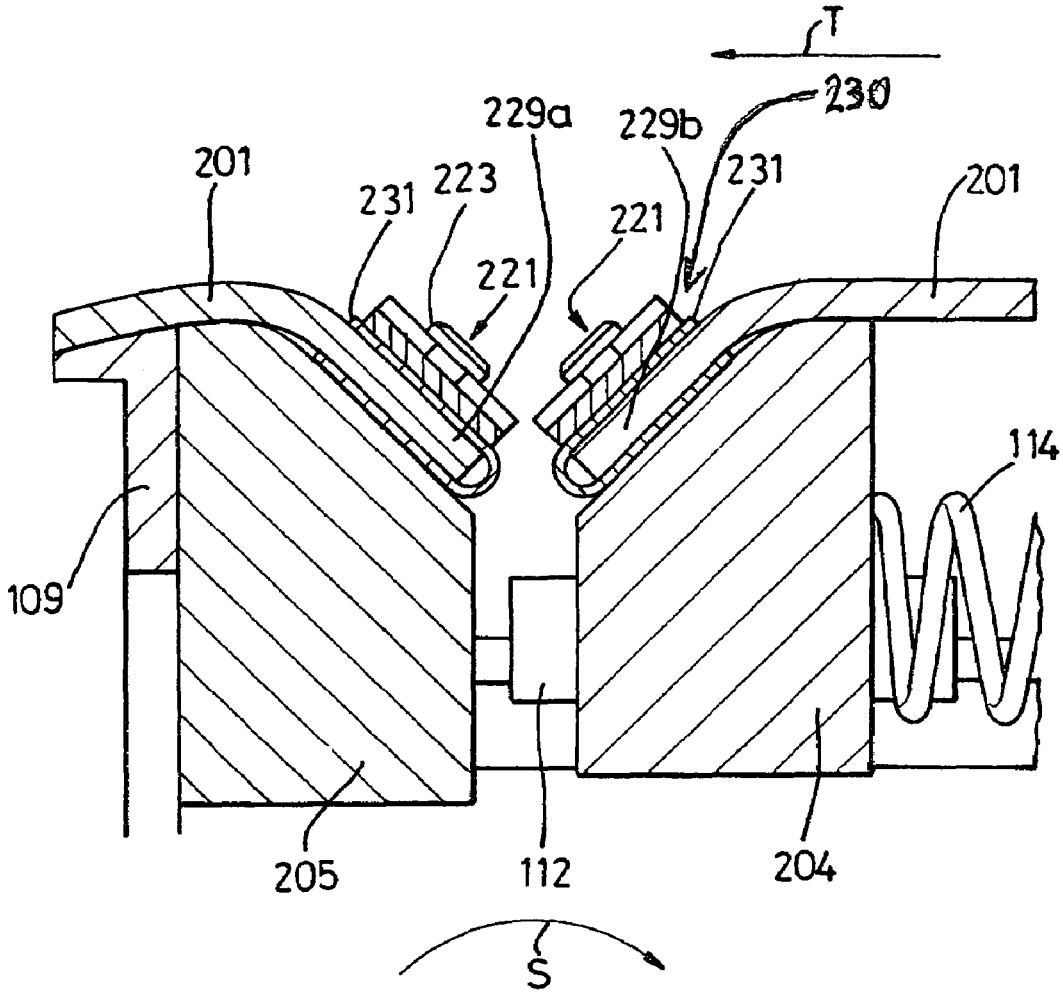
FIG. 10 is a cross-sectional view of the blanket securing assembly of the second embodiment of the invention.

Reference is now made to FIGS. 8, 9 and 10 which shows an alternative blanket fixing or attachment assembly 202. The blanket attachment assembly 202 has similarities with the blanket attachment assembly 102 and accordingly like reference numerals have been used to show like features. The blanket attachment assembly 202 essentially differs from the assembly 102 in that the fasteners 121 and the blind bores 116 are replaced by outwardly extending location pins 221 which are provided on the inclined surfaces of each of the blanket attachment bars 204 and 205. The blanket attachment bar 204 is mounted for sliding movement, and the blanket attachment bar 205 is fixedly mounted.

Figure 15C:
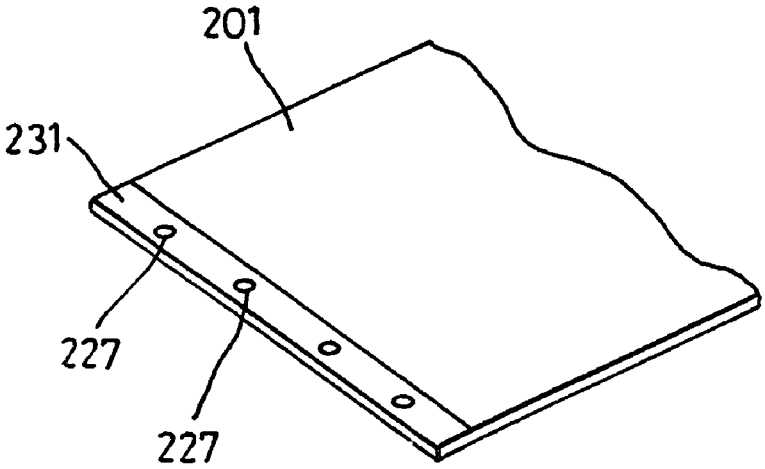

Each location pin 221 comprises a base portion 222, a headed portion 223 and an intermediate portion 224, see FIG. 9. The location pins 221 are adapted to be received by and locate blanket end assemblies 230. As shown in FIG. 10, each blanket end assembly 230 comprises an end portion 231, formed of metal and of substantially U-shape in section which is located at each end of the blanket 201 (as best seen in FIG. 15*c*). Each end portion 231 is attached to the blanket 201 by way of electrically conductive fasteners (not shown) which extend from the end portion through the blanket and into electrical contact with the electrically conductive layer of the blanket. Accordingly the end portions 231 are in electrical contact with the electrically conductive layer of the blanket 201.

Figure 10A:
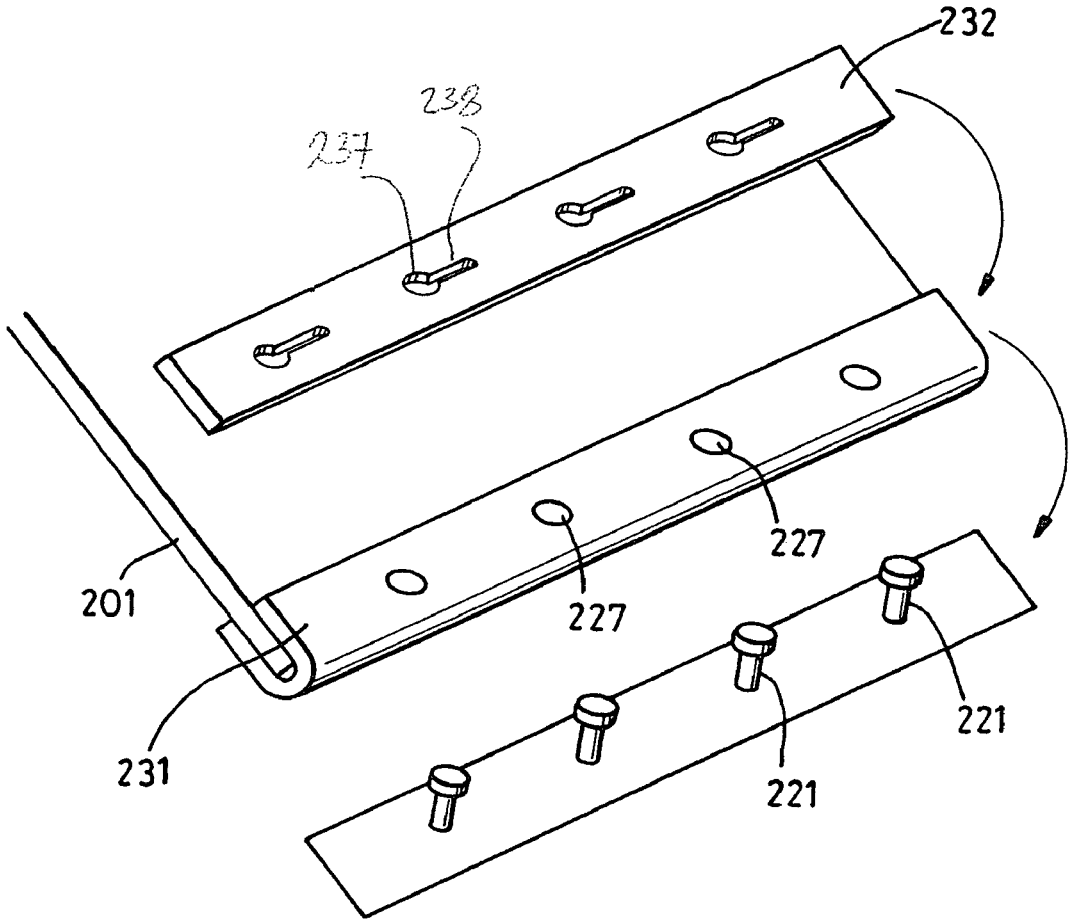
FIG. 10*a* is an exploded view which schematically shows the procedure of securing an end of a blanket using the blanket securing assembly.

An outer locking strip 232 is removably secured against each end portion 231, which is of stepped profile (as best seen in FIGS. 8 and 10*a*). At spaced intervals along the locking strip 232, there are provided key-hole shaped apertures 234 which each comprise at one end a region 237 which is of part circular outline, and at the other end an adjacent region 238 which is of generally straight outline. The aperture region 237 which is part circular is sized to be slightly greater than the size of the head portion 223, and the aperture region 237 which is of straight outline is narrower than the size of head 223. The aperture region of part circular outline is provided in a respective recessed portion 236 of each locking portion 232. Round apertures 227 are also formed in the blanket 201 and in the end portion 231. The procedure of securing the ends of the blanket 201 is schematically illustrated in FIG. 10*a*. The apertures 227 of each end portion are placed around the pins 221. The aperture regions 237 of each locking strip 232 are located around the pins 221 and each locking strip is urged in a substantially axial direction so as to bring the aperture region 238 into frictional engagement with respective pins to ensure that the blanket ends are held in position As seen in FIG. 8 the blanket 201 is held in position on the blanket mounting body 100 by way of the location pins 221 being located in the narrower regions 237 of the apertures formed at the ends of the blanket. In that condition neither end of the blanket can be lifted away from its respective blanket attachment bar 104 and 105 due to the presence of heads 223 of the location pins 221. Furthermore, an interference fit is provided by the way of the frictional interaction of the heads 223 with the locking portion 232.

If the blanket 201 is required to be removed from the blanket mounting body 100 a user needs simply to urge each of the locking portions 232 in a substantially axial direction so as to align the heads 223 of the location pins 221 with the part circular aperture regions 238 to enable each portion 232 to be removed from its respective blanket attachment bar 204 and 205. Each end of the blanket can then be lifted away. Installation of a replacement blanket is the reverse of those steps.

The fixed blanket attachment bar 205 is, in an identical manner to that discussed above in the first embodiment, connected to an electrical bias. With the blanket 201 in situ the electrical bias is connected to the conductive layer of the blanket by way of electrical contact between the surface 215 of each blanket attachment bar and the blanket end portions 231.

An hydraulic de-tensioning mechanism 219 is shown in FIG. 9 which is connected to the bar 204 and, in use, the user can control the mechanism to urge the bar 204 towards the back plate 111 so as to compress the springs 114 to allow a blanket to be removed to or be installed. The mechanism is mounted on a guide rail 219*a* for linear movement. On release of the mechanism 219 the springs are released and allowed to resiliently tension the blanket.

The de-tensioning mechanism need not be hydraulic. Hydraulic or not, a bar or formation may be moved in the longitudinal direction of the blanket fastening assembly (or unit) 102 (in the axial direction of the ITM drum) to operate a camming mechanism to force the dynamic, or moving, bar 204 backwards against the springs 114.

As also shown in FIG. 9 the blanket attachment bar 205 is provided with locating side wall portions 217 which serve to confine that end of the blanket which is attached to the bar 205.

In another embodiment, instead of being a separate component locking strip 232 could be permanently attached to, or integrated with, the end portion 231.

Figure 10B:
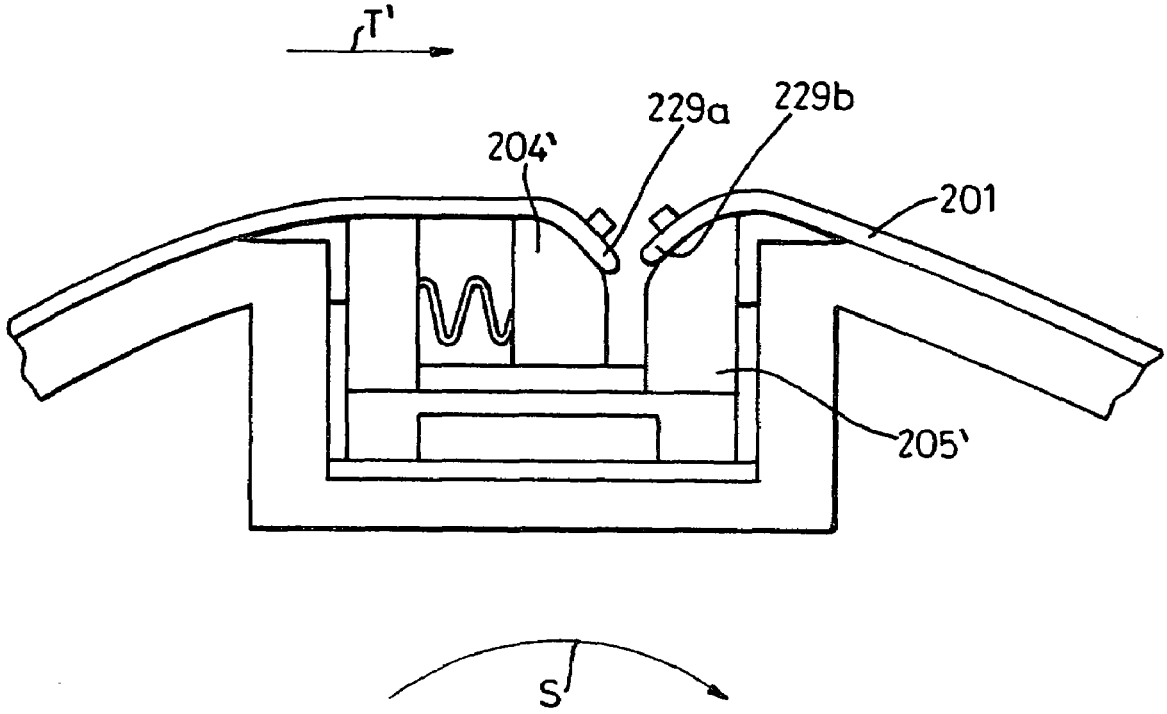
FIG. 10*b* shows a variant embodiment of that shown in FIG. 10.

With further reference to FIG. 10 it is seen that in use the blanket mounting body is rotated in sense S and that the direction of the tightening force is T. End 229*a* of the blanket 201 is the 'leading edge' and end 229*b* is the 'trailing edge'. This is then to be compared to the alternative arrangement in FIG. 10*b* which is very similar to the arrangement of FIG. 10 which comprises blanket attachment bars 204' and 205'. As compared to the embodiment in FIG. 10 the slideable bar (204') is connected to the leading edge 229*a*, whereas in FIG. 10*b* the slideable bar 204' is attached to the trailing edge 229*b*. Accordingly the direction of the tensioning T' in FIG. 10*b* is opposite to the direction of tensioning in FIG. 10.

Figure 11:
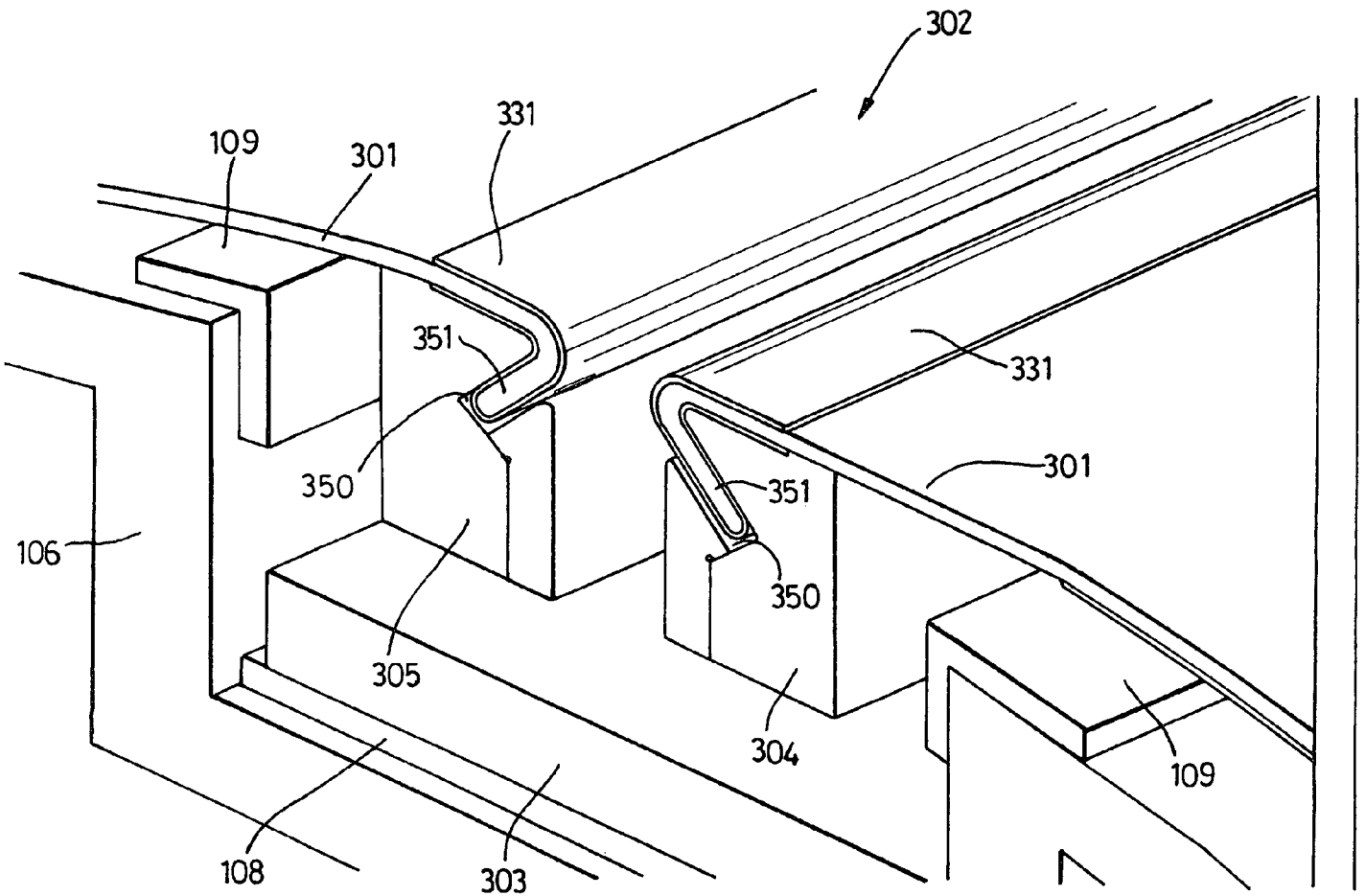
FIG. 11 is a perspective view of a blanket securing assembly of another embodiment of the invention.

Reference is now made to FIG. 11 which shows a blanket attachment assembly 302 which is used in another embodiment of the invention. Some of the features shown in FIG. 10 are identical to those of FIG. 4 and so like reference numerals have been used for like features. In the same manner as the first and second embodiments, the blanket attachment assembly comprises a fixedly mounted blanket attachment bar 305 which is secured to the base 303. The assembly 302 further comprises a blanket attachment bar 304 which is slidably mounted on rails (not shown), such as the rails 112 of the first embodiment, which rails are in sliding contact with linear bearings (not illustrated) which can be identical to the linear bearings 113. Multiple springs (not shown), for example identical to springs 114, resiliently bear against the blanket attachment bar 304.

Both of the blanket attachment bars 304 and 305 are provided with angled slots 350 which are adapted to receive bent end portions 351 of the blanket 301. The bent end portions 351 are bent back on themselves (recursive) and are enclosed by electrically conductive capping 331, which is in electrical contact with the electrically conductive layer of the blanket 301.

In use, and as shown in FIG. 11, each bent end portion 351 is securely located in a respective slot 350 of each blanket attachment bar. In order to remove the blanket 301 from the blanket attachment assembly 302 a user needs simply to use a de-tensioning mechanism to compress the springs temporarily so as to create slack. One end of the blanket is then lifted so that the respective bent end portion 351 is lifted out of the respective slot 350. The same procedure is then used to remove the other end of the blanket. In order to install a replacement blanket on the blanket mounting body 100 the reverse of the above procedure is used. Advantageously the blanket attachment assembly 302 does not require any tools to enable a user to either remove a blanket or install a replacement blanket.

In order to maintain the electrically conductive layer of the blanket at required electric potential, the fixed blanket attachment bar 304 is connected to an electrical biasing connection.

Figure 13:
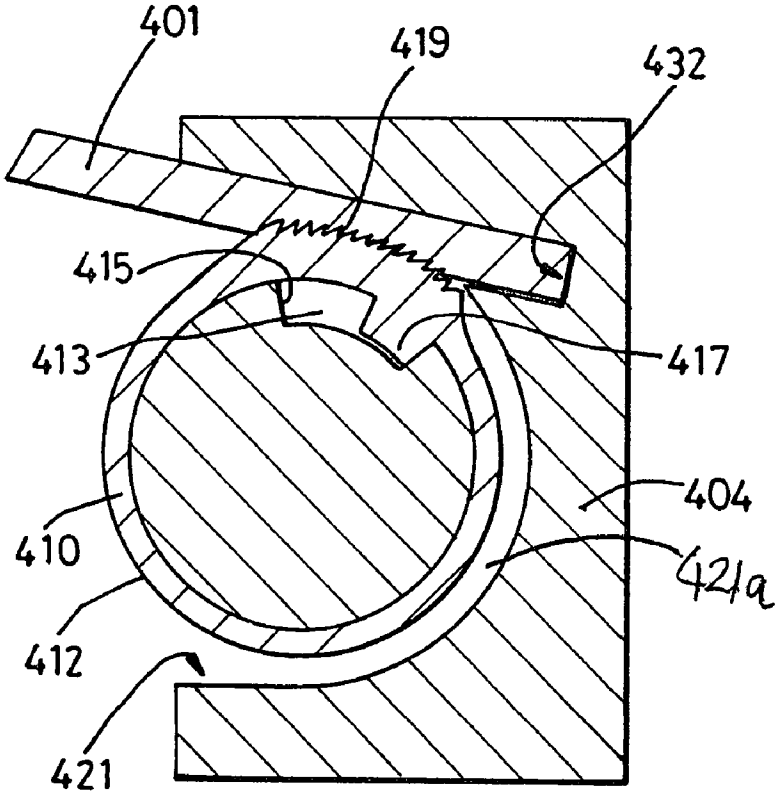
FIG. 13 is a cross-sectional view of the blanket securing assembly of FIG. 12 in a locked condition.
Figure 12:
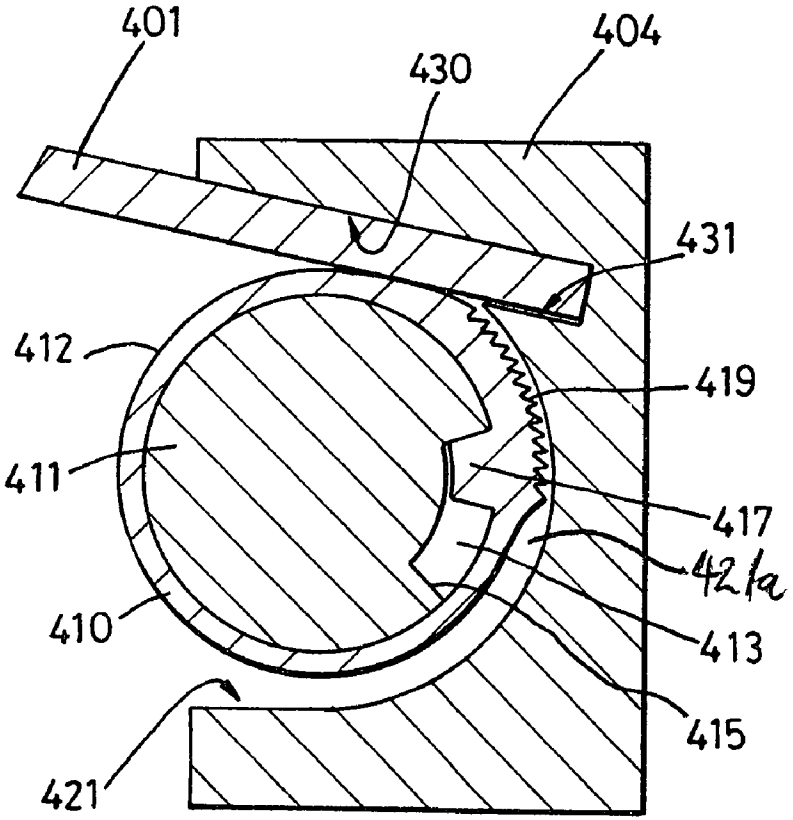
FIG. 12 is a cross-sectional view of a blanket securing assembly of another embodiment of the invention in an unlocked condition.

Reference is now made to FIGS. 12 and 13 which show part of a fourth embodiment of the invention which comprises a slidably mounted blanket attachment bar 404 which forms part of a blanket attachment assembly which is mounted on a blanket mounting body (not shown) for example similar to the blanket mounting body 100. The blanket attachment bar 404 is adapted to secure one end of the blanket 401. The blanket attachment assembly further comprises a fixedly mounted blanket attachment bar (not shown) which is adapted to grip the other end of the blanket 401 and is, in some embodiments, substantially identical to the blanket attachment bar 404.

The blanket attachment bar 404 comprises a rotatable gripping member 410 which is rotatable by a user by way of a rotatably mounted inner shaft 411. The rotatable gripping member comprises an arcuate field of teeth 419 and the teeth are at a greater radial position as compared to the remaining outer surface 412 of the gripping member 410 (the gripping member 410 so forming a cam).

The inner shaft 411 is provided with a part-annular recess 413, end surfaces 415 of which are selectively engageable with an inwardly extending, keying or rib member 417 of the gripping member 410.

The gripping member 410 is accommodated in a part-circular recess 421*a* in the blanket attachment bar 404 defined by part circular wall 421 of the bar 404.

The blanket attachment bar 404 is also provided with a flat, sloping blanket-receiving upper surface portion 430, lower blanket-receiving surface portion 431 and end surface portion 432. Together the surface portions 430, 431 and 432 define an inclined recess which is sized to receive an end of the blanket 401.

In order to secure one end of the blanket 401 to the blanket attachment bar 404 a user first inserts the end of the blanket into the recess defined by the surface portions 430, 431 and 432 to achieve the arrangement shown in FIG. 12 such that the blanket is brought into abutment with the end surface portion 432. However if such alignment is not required then the end of the blanket need not be brought into abutting engagement with the end surface portion 432. Using a handle device (not shown) connected to the inner shaft 411 the user rotates the shaft 411 in an anti-clockwise sense (as viewed in FIGS. 12 and 13). In so doing the (trailing) end surface 415 of the shaft 411 will bear against the rib member 417 of the gripping member 410 so as to rotate the gripping member and cause the teeth 419 to bite into the underside of the blanket 401, as shown in FIG. 12. By so penetrating into the blanket 401 the blanket is held in position in the blanket attachment bar 404. Moreover because the teeth 419 contact with the electrically conductive layer of the blanket 401 an electrical connection is formed between the gripping member 410 and the electrically conductive layer of the blanket 401. Thus, in this way if the gripping member 410 is used to maintain a desired electrical bias to the blanket 401.

The user then completes installation of the blanket 401 on the blanket mounting body by wrapping the blanket around the mounting body and repeating the above procedure to attach the other end of the blanket to the fixedly mounted blanket attachment bar. In order to remove the blanket 401 from the blanket mounting body the user needs simply to rotate the gripping member of each blanket attachment bar to release the teeth out of engagement with the blanket so that each end can then be removed.

It will be appreciated that in a similar fashion to the previously described embodiment a de-tensioning mechanism is provided which allows the user to compress the springs to as to allow installation and then to release the springs once the blanket ends have been attached to apply tension. Blanket removal is the reverse of this procedure.

With the above embodiment the blanket 401 advantageously does not require any additional attachments secured thereto to enable fastening thereof to the blanket attachment bars. This provides a considerable cost saving for manufacture of such blankets.

Figure 14:
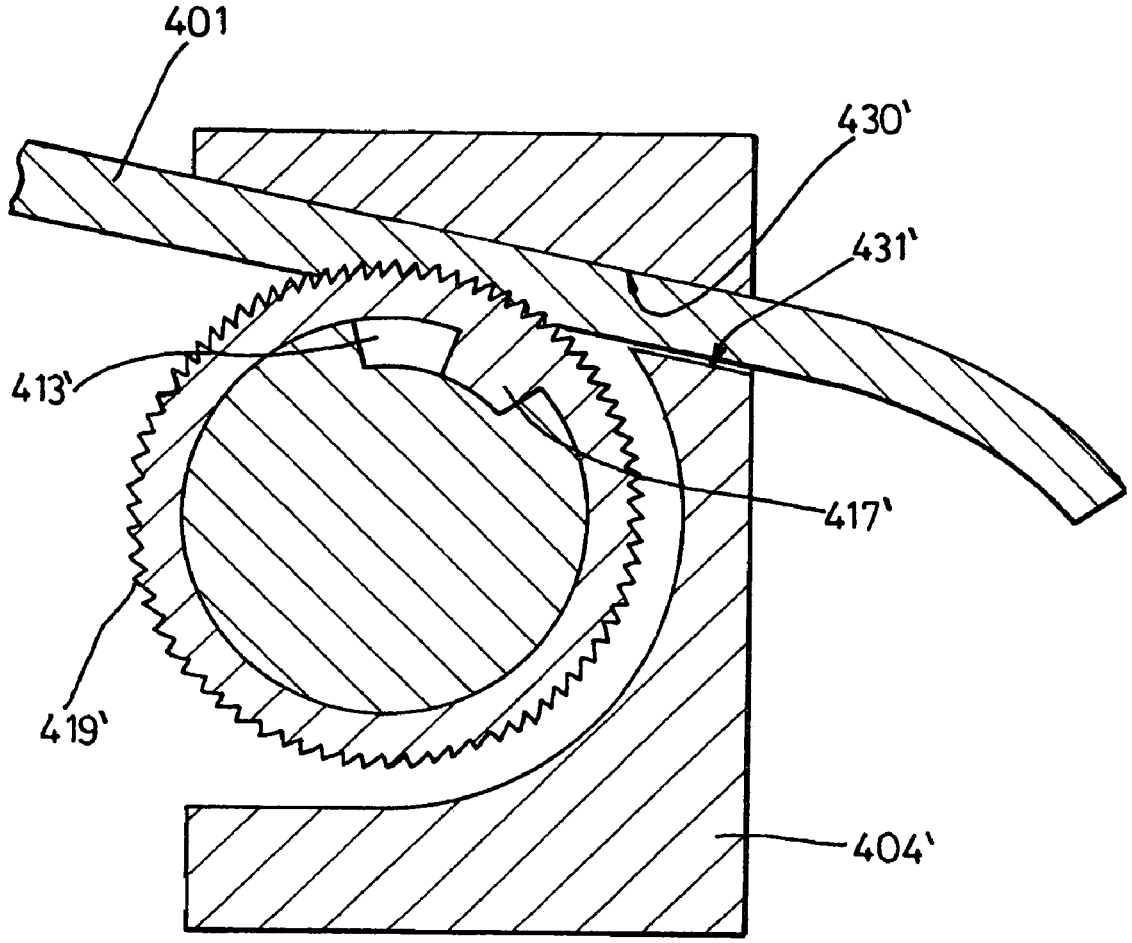
FIG. 14 is a cross-sectional view of a variant embodiment to that shown in FIG. 12 and 13, and FIGS. 15*a*, 15*b* and 15*c* are perspective views of end regions of various embodiments of image transfer blankets.

FIG. 14 shows a variant embodiment to that which is shown in FIGS. 12 and 13 in which the angular extent of a field of teeth 419' is increased and the recess defined by surface portions 430' and 431' is increased in length so as to create a through slot. This allows the user to control, to at least some extent, the position of the blanket attachment bar 404' relative to the blanket 401. Accordingly during an initial set up procedure the tension can be adjusted required by either causing the blanket to be fed towards the blanket attachment bar or causing the blanket to be fed out of and away from the blanket attachment bar. Operative engagement between the rib member 417' and the walls defining the recess 413' allow a user to rotate the field of teeth 419' as required. The arrangement shown in FIG. 14 allows the user to pull the blanket 401 through the slot after elongation due to creep has occurred and so 're-clamp' that end of the blanket at a different relative position.

The embodiments shown urge the two ends of the blanket towards each other (by urging their mounting bars (e.g. bars 104 and 105) towards each other). An alternative arrangement is also envisaged where the ends of the blanket/the bars 104 and 105 are urged away from each other. The blanket may wrap around the ITM drum for more than 360° (i.e. one end may overlap the other), and so urging the ends of the blanket away from each other tightens the blanket. A spring may act directly between the blanket mounting bars.

The invention claimed is:

1. An assembly, comprising:

an image transfer blanket;

an intermediate transfer member drum; and a blanket fastening assembly provided on the intermediate transfer member drum for securing the image transfer blanket around the drum, the blanket fastening assembly comprising a fixedly mounted member mounted on the drum and connected to one end of the blanket, and a slidably mounted member and a resilient biasing arrangement mounted on the drum and connected to the other end of the blanket, wherein the slidably mounted member is slidably mounted on one or more rails provided on the drum and passing through cut-outs in the slidably mounted member, and wherein the slidably mounted member and the resilient biasing arrangement are configured to resiliently tension the blanket around the drum, and move during the operational life of the drum so as to accommodate stretching of the blanket while maintaining tension in the blanket.

2. The assembly as claimed in claim 1 in which the blanket comprises an electrically conductive layer which is adapted to be held at a required electrical potential.

3. The assembly as claimed in claim 1 in which the slidably mounted member comprises a slidably mounted carriage positioned within an axial channel of the drum, in which the other end of the blanket is secured to the carriage.

4. The assembly as claimed in claim 3 in which the resilient biasing arrangement comprises at least one spring which bears against the carriage.

5. The assembly as claimed in claim 3 in which the carriage extends substantially an entire length of the axial channel, and the resilient biasing arrangement biases the carriage over substantially a full length of the carriage.

6. The assembly as claimed in claim 3 in which the carriage is slidably mounted for lateral movement within the axial channel on the one or more rails.

7. The assembly as claimed in claim 1 in which the fixedly mounted member is adapted to locate the one end of the blanket in a substantially fixed position relative to the intermediate transfer member drum, and the slidably mounted member is adapted to move the other end of the blanket relative to the intermediate transfer member drum so as to tension the blanket resiliently.

8. The assembly as claimed in claim 1 in which the blanket fastening assembly is in the form of a replaceable unit which is adapted to be replaceably attached to the intermediate transfer member drum, wherein the blanket fastening assembly has a generally oblong rectangular shape adapted to fit into an axial channel of the drum.

9. The assembly as claimed in claim 1 in which the blanket fastening assembly further comprises an electrical biasing connector adapted to electrically connect to an electrically conductive portion of the blanket.

10. The assembly as claimed in claim 1 in which the blanket fastening assembly further comprises a clamp arrangement which clamps an end of the blanket to an attachment bar of the blanket fastening assembly.

11. The assembly as claimed in claim 10 in which the clamp arrangement comprises a toothed portion which, in a clamped condition, bites into the blanket.

12. The assembly as claimed in claim 11 in which the toothed portion makes electrical contact with an electrically conductive portion of the blanket.

13. The assembly as claimed in claim 1 in which the blanket fastening assembly further comprises a tension adjustment arrangement which allows a user to adjust the resilient biasing arrangement so as to set an initial tension applied to the blanket.

14. The assembly as claimed in claim 1 in which the blanket fastening assembly further comprises a de-tensioning arrangement which acts on the resilient biasing arrangement against the action of a circumferential tensioning spring so as to reduce the tension to which the blanket is subjected.

15. An assembly, comprising:

an image transfer blanket;

an intermediate transfer member drum; and a blanket fastening assembly for securing the image transfer blanket around the intermediate transfer member drum, the blanket fastening assembly comprises a first attachment bar secured to a first end of the blanket and fixedly mounted within an axial channel of the drum, a second attachment bar secured to a second end of the blanket and slideably mounted within the axial channel of the drum on one or more rails disposed within the axial channel, and at least one biasing member which biases the second attachment bar toward the first attachment bar to resiliently tension the blanket around the drum, wherein the one or more rails extend between one side of the axial channel and the first attachment bar, and pass through cut-outs formed in the second attachment bar.

16. The assembly as claimed in claim 15 in which the first attachment bar and the second attachment bar each extend substantially an entire length of the axial channel, and the at least one biasing member biases the second attachment bar over substantially a full length of the second attachment bar.

17. The assembly as claimed in claim 15 in which the at least one biasing member comprises at least one spring which bears against the second attachment bar.

18. The assembly as claimed in claim 15 in which the blanket fastening assembly further comprises a clamp arrangement which clamps a respective end of the blanket to a respective attachment bar of the blanket fastening assembly.

19. The assembly as claimed in claim 18 in which the clamp arrangement comprises a toothed portion which, in a clamped condition, bites into the blanket.

20. The assembly as claimed in claim 19 in which the toothed portion makes electrical contact with an electrically conductive portion of the blanket.

* * * * *

UNITED STATES PATENT AND TRADEMARK OFFICE

CERTIFICATE OF CORRECTION

PATENT NO. : 7,644,658 B2
APPLICATION NO. : 11/249199
DATED : January 12, 2010
INVENTOR(S) : Sharon Nagler et al.

It is certified that error appears in the above-identified patent and that said Letters Patent is hereby corrected as shown below:

In column 18, line 20, in Claim 15, delete "slideably" and insert -- slidably --, therefor.

Signed and Sealed this

Thirteenth Day of July, 2010

David J. Kappos

David J. Kappos
*Director of the United States Patent and Trademark Office*